US011471901B2

(12) United States Patent
O'Reilly

(10) Patent No.: US 11,471,901 B2
(45) Date of Patent: Oct. 18, 2022

(54) DISPENSER

(71) Applicant: Allan O'Reilly, Rockwood Parade (IE)

(72) Inventor: Allan O'Reilly, Rockwood Parade (IE)

( * ) Notice: Subject to any disclaimer, the term of this patent is extended or adjusted under 35 U.S.C. 154(b) by 0 days.

(21) Appl. No.: 17/276,292

(22) PCT Filed: Sep. 13, 2019

(86) PCT No.: PCT/EP2019/074597

§ 371 (c)(1),
(2) Date: Mar. 15, 2021

(87) PCT Pub. No.: WO2020/053439

PCT Pub. Date: Mar. 19, 2020

(65) Prior Publication Data

US 2022/0023899 A1 Jan. 27, 2022

(30) Foreign Application Priority Data

Sep. 13, 2018 (IE) ..... 2018-0324

(51) Int. Cl.

| | |
|---|---|
| ***B05B 11/00*** | (2006.01) |
| ***B05B 11/04*** | (2006.01) |
| ***B65D 83/00*** | (2006.01) |

(52) U.S. Cl.

CPC ..... *B05B 11/048* (2013.01); *B05B 11/00412* (2018.08); *B05B 11/047* (2013.01); *B65D 83/0055* (2013.01)

(58) Field of Classification Search

CPC ..... B05B 11/048; B05B 11/00412; B05B 11/047; B05B 11/3011; B05B 11/061; B05B 11/02; B65D 83/0055

See application file for complete search history.

(56) References Cited

U.S. PATENT DOCUMENTS

| | | | |
|---|---|---|---|
| 3,519,167 | A | 7/1970 | Rast |
| 5,156,300 | A | 10/1992 | Spahni et al. |

(Continued)

FOREIGN PATENT DOCUMENTS

| | | | |
|---|---|---|---|
| EP | 9829432 | A1 | 3/1998 |
| EP | 1136387 | A1 | 9/2001 |

(Continued)

OTHER PUBLICATIONS

International Search Report and Written Opinion dated Dec. 16, 2019 for corresponding PCT/EP2019/074597; 15 pps.

*Primary Examiner* — Vishal Pancholi

(74) *Attorney, Agent, or Firm* — Renner, Kenner; Arthur M. Reginelli

(57) ABSTRACT

A dispenser for containing and dispensing substances such as fluids, viscous substances and/or adherent substances. The dispenser has a flexible bag adapted to contain a substance to be discharged, and a one-way output nozzle that is in sealed communication with the interior of the bag for discharging the contents of the bag. The dispenser has a receptacle, with the bag being arranged and sealed within the receptacle thereby trapping fluid between the exterior of the bag and the receptacle. The nozzle of the dispenser is arrangeable on a surface of the receptacle and there is additionally a one-way fluid intake valve arranged on the receptacle for intaking fluid into the receptacle and around the exterior of the bag. The dispenser further has an arrangement for preventing the bag from blocking the nozzle. The contents of the bag can be emptied through the nozzle without the bag blocking the nozzle in use.

19 Claims, 16 Drawing Sheets

(56) References Cited

U.S. PATENT DOCUMENTS

| | | | | |
|---|---|---|---|---|
| 8,464,908 | B1 * | 6/2013 | Tabor | B65D 51/1644 222/464.2 |
| 8,640,920 | B2 * | 2/2014 | Sharp | B65D 75/52 222/103 |
| 8,960,502 | B2 * | 2/2015 | Stehli, Jr. | B65B 3/04 222/105 |
| 2006/0226171 | A1 | 10/2006 | Sternberg | |
| 2007/0151987 | A1 | 7/2007 | Arghyris et al. | |
| 2012/0111894 | A1 * | 5/2012 | Bakhos | B65D 35/28 222/386.5 |
| 2012/0312839 | A1 | 12/2012 | Stehli, Jr. et al. | |
| 2014/0166699 | A1 * | 6/2014 | Stehli, Jr. | B65D 83/0055 222/209 |
| 2015/0210420 | A1 * | 7/2015 | Hosokoshiyama | B29C 49/06 215/44 |

FOREIGN PATENT DOCUMENTS

| | | | |
|---|---|---|---|
| GB | 2253387 | A | 9/1992 |
| WO | 9113003 | A1 | 9/1991 |
| WO | 2006107403 | A2 | 10/2006 |

* cited by examiner

DISPENSER

The present invention relates to a dispenser. In particular, a dispenser having a bag disposed within a receptacle.

Dispensers for viscous liquids such as condiments are known, for example glass bottles or squeezable plastic bottles with a cap having a nozzle. The problem with these dispensers in both instances is that residual amounts of the contents adhere to the inner surfaces of the dispenser and these are generally inaccessible, resulting in waste either when the dispenser is washed or discarded. One known solution to this problem is a dispenser having a one-way air intake valve on its base and a flexible bag disposed within the dispenser. The bag is filled with a viscous liquid and when the dispenser is squeezed the volume of the bag is reduced and the viscous liquid is forced out of the nozzle. When the squeezing force is released air enters through the air intake valve and prevents the bag from returning to its original volume. The contents of the bag remain located adjacent to the nozzle and can easily be dispensed by squeezing and, when the dispenser is emptied, only a nominal residual amount of the contents remains adhered to the surface of the bag. The bag can either be refilled or discarded and replaced with a new, pre-filled bag.

One problem with these bag-based dispensers occurs during loading of the dispenser with a pre-filled bag. If the bag is too large it will press against the inner surfaces of the dispenser creating a seal. Air becomes trapped in the space between the bag and the base of the dispenser and the bag cannot be inserted into the dispenser. The only solution is to use a smaller pre-filled bag which increases the amount of the contents wasted due to having to replace the bag more frequently. Furthermore, the smaller bag has a higher surface area to volume ratio than the large bag, so the amount of plastic used per volume of condiment (or other substance) is greater, and therefore less environmentally friendly than using larger bags. In determining the size of bag to be used, consideration must also be given to warping and stretching of the bag which occurs in the bags during storage, and it is required to reduce the size sufficiently to accommodate this.

A further problem with bag-based dispensers is that a part of the bag can be drawn over the nozzle during use, blocking the nozzle and preventing the contents from being dispensed. To overcome this problem, the dispenser cap must be loosened to allow air to enter into the bag and for the bag to deform away from the nozzle however this does not prevent the problem from reoccurring. Yet a further problem with bag-based dispensers is that after a small amount of the contents has been disposed they become top heavy as the contents are forced up to the cap of the dispenser, with the base-end of the dispenser being filled only with air. Accordingly, they are easily toppled.

It is an object of the invention to obviate or mitigate the problems of bag-based dispensers outlined above.

It is an object of the invention to obviate or mitigate the problem of trapped air limiting the size of bag that can be used in a dispenser.

It is an object of the invention to obviate or mitigate the problem of bags blocking the nozzle of a dispenser during use.

According to a first aspect of the invention there is provided a dispenser for containing and dispensing substances such as fluids, viscous substances and/or adherent substances, the dispenser comprising:

- a flexible bag adapted to contain a substance to be discharged,

- a one-way output nozzle that is in sealed communication with the interior of the bag and is adapted for discharging the contents of the bag,
- a substantially impermeable receptacle, the bag being arranged within the receptacle and the receptacle being sealed, with fluid being trapped between the exterior of the bag and the receptacle, the nozzle being arranged on a surface of the receptacle,
- a one-way fluid intake valve arranged on the receptacle for intaking fluid into the receptacle and around the exterior of the bag, and
- a means for preventing the bag from blocking the nozzle.

By "viscous" we mean any substance having a consistency between that of solids and liquids and comprises, for example, gels, pastes and creams. By "adherent" we mean any substance, including solids, that is sticky and/or has an affinity to at least one of the surfaces of 25 the dispenser (for example, by virtue of the substance being electrically charged). By "fluid" we mean a gas or liquid. By "substantially impermeable" we mean that the material is usually impermeable to fluids under standard atmospheric temperature and pressure.

Advantageously, during discharge of the contents, the bag is prevented from blocking the nozzle and all or most of the contents of the bag can be discharged without blockage.

Ideally, the receptacle is formed from substantially impermeable material.

Preferably, the nozzle is in an airtight arrangement with the receptacle such that air cannot enter the receptacle where the nozzle meets the receptacle.

Ideally, the means for preventing the bag from blocking the nozzle comprises a portion of the bag being rigid and/or rigidified.

By "rigid" we mean that a portion of the bag is more rigid than another different portion of the bag, and by "rigidified" we mean a portion of the bag that has been made more rigid than another different portion of the bag.

Preferably, the rigid/rigidified portion of the bag is located proximal to the nozzle.

Advantageously, the rigid/rigidified portion is prevented from easily deforming towards the nozzle during discharge of the contents from the bag. Less-rigid/non-rigidified portions of the bag will deform and move towards the nozzle whereas the rigid/rigidified portion will resist deformation thereby leaving the nozzle clear and allowing passage of the contents of the bag through the nozzle.

Preferably, the rigid/rigidified portion operates as a funnel in use to funnel the contents of the bag towards the nozzle.

Ideally, the flexible bag comprises a plurality of rigid/rigidified portions.

Preferably, the plurality of rigid/rigidified portions are spaced apart from one another.

Preferably, the plurality of rigid/rigidified portions are separated by a less-rigid/non-rigidified portion extending therebetween.

Ideally, the plurality of rigid/rigidified portions are arranged along the length of the bag in the direction extending away from the nozzle.

Preferably, the at least one rigid/rigidified portion extends around the perimeter of the bag.

Ideally, the at least one rigid/rigidified portion extends around the perimeter of the bag perpendicular to the longitudinal axis of the bag.

Advantageously, as the bag is emptied in use, the less-rigid portions will collapse inwards and fold against the rigid/rigidified portions. The rigid/rigidified portions will move towards each other but remain structurally intact, with their shape changing only slightly, if at all, during emptying of the bag. This acts to keep the bag away from the nozzle until the contents of the bag are nearly completely emptied from the bag.

Ideally, as the bag is emptied the less-rigid/non-rigidified portion will collapse inwards in a direction towards the nozzle.

Ideally, at least one of the rigid/rigidified portions is a portion proximal to the nozzle.

Preferably, the means for preventing the bag from blocking the nozzle comprises a means for rigidifying a portion of the bag.

Ideally, the means for rigidifying a portion of the bag rigidifies a portion of the bag proximal to the nozzle.

Preferably, the means for rigidifying a portion of the bag forms the rigid/rigidified portion of the bag.

Ideally, the means for rigidifying a portion of the bag comprises a bag-reinforcing means operable to reinforce a portion of the bag.

Advantageously, this reinforces a part of the bag and prevents it from easily collapsing inwards. During use, any non- or less-reinforced portions will collapse inwards whereas the shape of the reinforced portions is maintained. This enables the manufacturer to determine the collapse pattern of the bag.

Most preferably, the bag-reinforcing means is operable to reinforce a part of the bag proximal the nozzle.

Advantageously, the portion of the bag proximal the nozzle is retained in a rigidified state during discharge of the contents.

In one embodiment, the means for rigidifying a portion of the bag rigidifies a plurality of portions of the bag.

In one embodiment, the bag-reinforcing means comprises the bag being formed having varying thicknesses, such that the thicker portion(s) of the bag are reinforced relative to the thinner portions.

Alternatively or additionally, the bag-reinforcing means comprises the bag being formed from at least two different materials wherein one material has a lower flexural rigidity than the other material.

Alternatively or additionally, the bag-reinforcing means comprises at least one structural support.

Ideally, the at least one structural support being attached to the bag.

In one embodiment, the structural support comprises a rigidifying support extending along a part of the bag.

Ideally, the at least one structural support being formed from wood, metal, plastic and/or composite and/or other suitable material.

Preferably, the bag is formed at least partially from plastic.

Ideally, the bag is formed at least partially from polyethylene, polyvinylchloride, polypropylene and/or polylactic acid.

In one embodiment, the means for rigidifying a portion of the bag comprises a biasing means for biasing a portion of the bag outwards from the longitudinal axis of the bag.

Ideally, the biasing means is operable to bias the portion of the bag proximal to the nozzle away from the nozzle.

In this embodiment, the biasing means is attached to and/or presses against a portion of the bag to bias said portion outwards.

Ideally, the biasing means pushes the interior of the bag outwards and/or pulls the exterior of the bag away from the centre of the bag.

Ideally, the receptacle is openable.

Advantageously, this provides access to the bag.

Ideally, the bag is refillable and/or replaceable.

Advantageously, this improves the number of uses of the dispenser and increases its lifespan.

In one embodiment, the nozzle is integrally formed with the receptacle.

Ideally, the dispenser, most preferably the receptacle, comprises a cap.

Ideally, the nozzle is disposed on the cap.

Preferably, the nozzle is integrally formed with the cap.

Preferably, the receptacle comprises a main body.

Preferably, the cap is at least partially removable from the main body of the receptacle.

Advantageously, removing the cap provides access to the main body of the receptacle.

Preferably, the cap is engageable with the main body of the receptacle.

Ideally, the cap forms a seal with the main body of the receptacle.

Preferably, the cap is screw-fitted on to the main body of the receptacle.

Advantageously, the screw-fitting provides an air-tight seal.

Alternatively, the cap can be fastened to the receptacle with fasteners that extend from the cap to a fastener receiving means on the receptacle.

Ideally, the fasteners enable releasable fastening of the cap to the receptacle.

Preferably, the fasteners are clips.

Ideally, the fasteners are hingedly arranged on the cap.

Ideally, the fastener receiving means is a groove or channel for receiving a portion of the fastener and retaining the fastener thereto.

Advantageously, by using fasteners instead of a screw-fit arrangement, the shape of the dispenser can be a shape other than circular, for example, a dispenser having a square or rectangular base, or any desired geometric shape.

In this embodiment, the dispenser comprises a compressible seal that extends between the cap and the receptacle when the cap is fitted to the receptacle.

Advantageously, this ensures an airtight seal between the cap and the receptacle.

Ideally, the compressible seal is formed from rubber or other suitable substance.

Ideally, the bag is disposed within the main body of the receptacle.

Ideally, the bag is adapted to form a seal with the cap and/or the main body such that the interior of the bag is in communication with the nozzle and the exterior of the bag is in fluid communication with the fluid-intake valve.

Preferably, part of the bag is disposable between the cap and the main body when the cap is fitted on the main body.

Ideally, part of the bag is disposed between the cap and the main body.

Ideally, the main body has a rim.

Preferably, the cap has a surface, most preferably a planar surface, engageable with the rim and forming a seal therewith.

Ideally, the bag comprises a means for engaging with the receptacle or cap.

Preferably, the means for engaging with the receptacle or cap comprises a lip shaped to engage with receptable to retain the bag at the receptacle.

Alternatively or additionally, the means for engaging with the receptacle or cap could be adhesives or other mechanical engagement means.

Preferably, the lip can be disposed between the cap and the main body, most preferably, between the rim of the main body and the inner surface of the cap.

Preferably, arranging the cap on the main body seals part of the bag against the cap and the main body.

Alternatively, the interior of the cap is shaped to accommodate a part of the bag.

Ideally, in this embodiment, the interior of the cap comprises a groove to receive the lip of the bag.

In one embodiment, the means for engaging with the receptacle or cap, most preferably the lip, is integrally formed with at least part of the means for rigidifying a portion of the bag.

Ideally, the means for engaging with the receptacle or cap, most preferably the lip, is integrally formed with at least part of the bag-reinforcing means.

Ideally, the means for engaging with the receptacle or cap, most preferably the lip, is integrally formed with at least part of at least one structural support.

Alternatively, the means for engaging with the receptacle or cap, most preferably the lip, and the means for rigidifying a portion of the bag are distinct components.

Ideally, arranging the cap on the main body fixes the bag within the receptacle.

In one embodiment, the receptacle is formed from flexible, resilient material.

Preferably, the receptacle is compressible.

Ideally, the receptacle is resilient.

Ideally, the receptacle is squeezable by a user thereby temporarily reducing the volume of the receptacle.

Ideally, the receptacle is formed at least partially from plastic.

Preferably, the receptacle is formed at least partially from polyethylene, polyvinylchloride, polypropylene and/or polylactic acid.

Advantageously, the properties of the receptacle, including its compatibility with different contents, can be altered by manufacturing the receptacle from different materials.

In one embodiment, the dispenser comprises nanomaterials.

Ideally in this embodiment, the receptacle is formed at least partially from nanomaterials.

Additionally or alternatively, the bag is formed at least partially from nanomaterials.

Preferably, the receptacle and/or the bag is formed at least partially from nano-engineered materials.

Preferably, when the volume of the receptacle is reduced by compression, the bag is correspondingly compressed and the contents of the bag are forced out through the nozzle.

Preferably, the receptacle is expandable from a compressed state.

Ideally, when a compressive force acting on the receptacle is removed the receptacle expands.

Ideally, when the receptacle expands fluid enters the receptacle through the fluid-intake valve.

Preferably, the fluid is air.

Alternatively, the fluid may be water or other fluid.

Advantageously, the receptacle returns to its non-compressed form but the bag remains compressed as the fluid that has entered the receptacle through the fluid-intake valve prevents the bag from returning to a non-compressed state. The contents of the bag are therefore retained adjacent to the nozzle.

In one embodiment, the dispenser comprising a fluid-intake pump.

Ideally, the fluid-intake pump is operable by hand.

Alternatively, the fluid-intake pump may be operated by mechanical means.

Ideally, the fluid-intake pump is operably connected to the fluid-intake valve such that, when operated, the fluid-intake pump pumps fluid through the valve into the receptacle.

Advantageously, as fluid is pumped into the receptacle the bag is compressed and the contents of the bag are forced out the nozzle.

In an embodiment of the invention wherein the dispenser comprises a fluid-intake pump, the receptacle can be formed from rigid and/or non-resilient materials such as glass or some metals.

Advantageously, this uses less plastic and is therefore more environmentally friendly.

Ideally, the fluid-intake valve is located proximal the nozzle.

Preferably, the fluid-intake valve is disposed on the cap.

Ideally, the fluid-intake valve is integrally formed with the cap.

Preferably, the receptacle, most preferably the main body of the receptacle, comprises at least one aperture alignable with the fluid-intake valve such that fluid communication between the aperture and the fluid-intake valve is permissible.

Ideally, the main body of the receptacle comprises a plurality of apertures alignable with the fluid-intake valve.

Advantageously, this increases the number of fluid-entry points between the fluid-intake valve and the interior of the main body and can increase the rate of fluid flow into the receptacle.

Ideally, the plurality of apertures are equi-spaced around the perimeter of the main body.

Ideally, the plurality of apertures are equi-spaced around the perimeter of the main body perpendicular to the longitudinal axis of the main body.

Advantageously, this provides an even spread of fluid-entry points thereby permitting fluid to enter the receptacle from a plurality of different angles and not limiting fluid-entry to a single side of the receptacle which could lead to the bag being unevenly compressed at one side thereby offsetting the centre of gravity of the dispenser.

Ideally, the dispenser comprises a fluid travel pathway to permit transfer of fluid into and/or throughout the receptacle.

Preferably, the fluid travel pathway permits transfer of fluid from outside the dispenser through the fluid-intake valve, into the receptacle and around the exterior of the bag.

Ideally, the fluid travel pathway is arranged to transfer fluid from the fluid-intake valve to throughout the receptacle.

Ideally, the fluid travel pathway is arranged to transfer fluid from the fluid-intake valve along the length of the receptacle.

Preferably, the fluid travel pathway is arranged to transfer fluid evenly around the exterior of the bag.

Ideally, the receptacle, most preferably the main body, has a base.

Preferably, the fluid travel pathway is arranged to transfer fluid from the fluid-intake valve to a location at or near the base of the receptacle.

Advantageously, this permits the fluid-intake valve to be disposed proximal the nozzle, for example, on the cap. In contrast, prior art dispensers must have the fluid-intake valve disposed near the base of the receptacle as there is no means for transferring fluid from the fluid-intake valve along the length of the receptacle thereby evenly spreading the fluid around the exterior of the bag.

Ideally, the fluid travel pathway comprises a fluid transfer means between the fluid-intake valve and the main body of the receptacle.

Preferably, the fluid transfer means permits transfer of fluid from the fluid-intake valve to at least one aperture on the receptacle, most preferably when the cap is arranged on the main body.

Ideally, the fluid transfer means comprises a space formed between the cap and the main body of the receptacle when the cap is arranged on the main body.

Preferably, the fluid-intake valve is in sealed fluid-communication with the space when the cap is arranged on the main body of the receptacle.

Ideally, there are fluid-tight boundaries above and below the space when the cap is arranged on the receptacle.

Ideally, the space is formed from a groove and/or a non-threaded portion of the cap and/or the main body.

Preferably, a fluid-tight boundary of the space is defined by the cap pressing against the bag and/or the rim of the main body of the receptacle.

Ideally, the threaded portion of the cap and the main body of the receptacle defines a further, fluid-tight boundary of the space when the threaded portion of the cap is engaged with the threaded portion of the main body.

In one embodiment, the fluid-tight boundary is provided by the threaded portions of the cap and main body at either side of the space.

Ideally, the groove or non-threaded portion extends from the planar surface of the cap and mutually opposes a portion of the main body when the cap is arranged on the main body.

Preferably, the space extends around at least part, most preferably all, of the outer perimeter of the main body of the receptacle.

Ideally, the space extends perpendicular to the longitudinal axis of the main body.

Ideally, the fluid travel pathway comprises an inner-receptacle fluid travel means located on the inside of the receptacle.

Preferably, the inner-receptacle fluid travel means is operable to permit free movement of fluid, most preferably air, around the interior of the main body of the receptacle even when the main body contains contents such as the bag.

Preferably, the inner-receptacle fluid travel means is in fluid communication with the fluid-intake valve.

Ideally, the inner-receptacle fluid travel means is in fluid communication with at least one aperture.

Preferably, the inner-receptacle fluid travel means is in fluid communication with the space formed between the cap and the main body of the receptacle when the cap is arranged on the main body.

Preferably, the inner-receptacle fluid travel means extends from at or about the fluid-intake valve or from at least one aperture of the receptacle along the main body.

Ideally, the inner-receptacle fluid travel means extends from at or about where the main body engages with the cap.

Ideally, the inner-receptacle fluid travel means comprises at least one groove, channel and/or tube, most preferably, a plurality of grooves, channels and/or tubes.

Preferably, at least one groove, channel and/or tube is linear, most preferably rectilinear.

Ideally, at least one groove, channel and/or tube extends orthogonally to the base of the main body.

Preferably, the plurality of grooves, channels and/or tubes are parallel to one another.

Ideally, the plurality of grooves, channels and/or tubes are equi-spaced around the perimeter of the main body.

Advantageously, this permits an even flow of fluid around the exterior of the bag.

Preferably, the inner-receptacle fluid travel means extends along the receptacle towards the base of the receptacle.

Advantageously, when the bag is being removed or replaced, the inner-receptacle fluid travel means allows fluid to travel from the space in the receptacle between the bottom of the bag and the base of the receptacle to the exterior of the receptacle. This allows a bag to be easily removed as the fluid, e.g. air, can bypass the bag to fill the space between the bag and the receptacle thereby preventing a suction force from holding the bag within the receptacle. The inner-receptacle fluid travel means is further advantageous when inserting a filled bag into the receptacle. The filled bag tends to press against the sides of the receptacle forming a seal with the receptacle. The fluid between the bottom of the bag and the base of the receptacle becomes trapped and resists the bag from being inserted further into the receptacle. The prior art overcomes this problem by using a smaller bag. The current solution permits large bags to be used as the fluid below the bag can escape the receptacle through the inner-receptacle fluid travel means.

In one embodiment, the dispenser comprises a stand.

Ideally, the stand is integrally formed with the receptacle.

Preferably, the stand extends from the receptacle, most preferably from the cap, to a distance beyond the nozzle such that the dispenser can be inverted and set on a surface.

Advantageously, the dispenser can be stored in this position. As the bag is emptied, the centre of gravity of the dispenser moves towards the nozzle. By storing the dispenser with the nozzle close to a surface, the centre of gravity is also correspondingly closer to the surface than if the dispenser were stored with the nozzle orientated away from the surface. This makes it less easy to topple the dispenser.

Ideally, the one-way output nozzle is adjustable to adjust the rate of output of the contents.

Preferably, the one-way output nozzle permits passage of contents out of the dispenser but does not allow fluid to enter in through the nozzle.

Ideally, the nozzle uses mechanical means to prevent fluid entering.

In one embodiment, the nozzle operates by retaining an amount of the contents within the nozzle thereby blocking the nozzle, either as a result of the viscous properties of the contents and/or the shape of the nozzle.

Ideally, the nozzle comprises a nozzle adjuster.

Preferably, the nozzle adjuster is rotatable about the longitudinal axis of the nozzle.

Ideally, rotating the nozzle adjuster in a first direction widens the nozzle.

Preferably, rotating the nozzle adjuster in a second direction narrows the nozzle.

Advantageously, the adjustable nozzle enables the same dispenser to be used for a range of different contents having different properties regarding viscosity. This increases the usability and environmental friendliness of the dispenser.

Ideally, the nozzle comprises a grip.

Preferably, the grip is disposed on the nozzle adjuster.

Ideally, the nozzle is cylindrical or other suitable shape.

In one embodiment, the one-way output nozzle is operably engaged with an extraction pump.

Preferably, operation of the pump draws the contents of the bag out of the nozzle.

Ideally, the extraction pump is a hand-operated pump.

In one embodiment, the one-way fluid intake valve is adjustable to adjust the rate of fluid-flow into the dispenser.

In the embodiment wherein the receptacle is squeezable, the fluid-intake valve operates to return the receptacle to its non-compressed form after it has been squeezed to dispense a quantity of the contents. Advantageously, adjusting the valve can adjust the time taken for the receptacle to return to the non-compressed form. For example, it may be desired to have a slow intake of fluid where fine control of the dispenser is required and where a rapid intake of fluid could lead to undesired erratic movements.

Ideally, the fluid intake valve comprises a valve adjuster.

Ideally, the valve adjuster is rotatable about the longitudinal axis of the valve.

Ideally, rotating the valve adjuster in a first direction widens the valve.

Preferably, rotating the valve adjuster in a second direction narrows the valve.

Ideally, the fluid intake valve is a duckbilled valve, umbrella valve, combination valve or any suitable valve.

According to a second aspect of the invention there is provided a receptacle of a dispenser, the receptacle comprising a fluid travel pathway to permit transfer of fluid into and/or throughout the receptacle, the fluid travel pathway comprising an inner-receptacle fluid travel means located on the inside of the receptacle.

Preferably, the receptacle comprises at least one aperture alignable with a fluid-intake valve.

Ideally, the receptacle comprises a plurality of apertures alignable with at least one fluid-intake valve.

Advantageously, this increases the number of fluid-entry points between the fluid-intake valve and the interior of the receptacle and can increase the rate of fluid flow into the receptacle.

Ideally, the plurality of apertures are equi-spaced around the perimeter of the receptacle.

Preferably, the plurality of apertures are aligned in a plane perpendicular to the longitudinal axis of the receptacle.

Ideally, the receptacle comprises a main body and a cap.

Preferably, the cap comprising a fluid-intake valve.

Preferably, the inner-receptacle fluid travel means extends from at least one aperture along the main body of the receptacle.

Ideally, the inner-receptacle fluid travel means comprises a groove, channel and/or tube.

Preferably, the receptacle comprises a base.

Ideally, the inner-receptacle fluid travel means extends along the main body of the receptacle towards the base.

According to a third aspect of the invention there is provided a flexible bag for use with a dispenser for containing and dispensing substances such as fluids, viscous substances and/or adherent substances, the flexible bag being adapted to contain a substance to be discharged from the dispenser, the flexible bag further comprising a rigid/rigidified portion.

Preferably, the rigid/rigidified portion having a higher flexural rigidity than a less rigid/rigidified portion.

Ideally, the bag has an opening and the rigid/rigidified portion is located at or about the opening.

Ideally, the bag comprises a plurality of rigid/rigidified portions.

Preferably, the plurality of rigid/rigidified portions are spaced apart from one another.

Preferably, the plurality of rigid/rigidified portions are separated by a less-rigid/non-rigidified portion extending therebetween.

Ideally, the plurality of rigid/rigidified portions are arranged along the length of the bag in the direction extending away from the opening.

Preferably, the at least one rigid/rigidified portion extends around the perimeter of the bag, most preferably, perpendicular to the longitudinal axis of the bag.

Advantageously, as the bag is emptied in use, the less-rigid, flexible portions will collapse inwards and fold against the inner walls of the rigid/rigidified portions. The rigid/rigidified portions will move towards each other but will not begin to collapse until the less-rigid/non-rigidified portions are collapsed.

Preferably, the bag comprises a means for rigidifying a portion of the bag.

Ideally, the means for rigidifying a portion of the bag rigidifies a portion of the bag proximal to the opening.

Preferably, the means for rigidifying a portion of the bag forms the rigid/rigidified portion of the bag.

Ideally, the means for rigidifying a portion of the bag comprises a bag-reinforcing means operable to reinforce a portion of the bag.

Advantageously, this reinforces a part of the bag and prevents it from easily collapsing inwards. During use, any non- or less-reinforced portions will collapse inwards first, followed by any reinforced portions. This enables the manufacturer to determine the collapse pattern of the bag by altering the location of the rigid/rigidified portions.

Most preferably, the bag-reinforcing means is operable to reinforce a part of the bag proximal the opening.

Advantageously, the portion of the bag proximal the opening is retained in a rigidified state until the bag is nearly completely emptied.

In one embodiment, the means for rigidifying a portion of the bag rigidifies a plurality of portions of the bag.

In one embodiment, the bag-reinforcing means comprises the bag being formed having varying thicknesses, such that the thicker portion(s) of the bag is/are reinforced relative to the thinner portion(s).

Alternatively or additionally, the bag-reinforcing means comprises the bag being formed from at least two different materials wherein one material has a lower flexural rigidity than the other material.

Alternatively or additionally, the bag-reinforcing means comprises at least one structural support.

In one embodiment, the structural support comprises a rigidifying support extending along a part of the bag.

Ideally, the at least one structural support being formed from wood, metal, plastic and/or composite or other suitable material.

In one embodiment, the means for rigidifying a portion of the bag comprises a biasing means for biasing a portion of the bag outwards from the longitudinal axis of the bag.

Ideally, the biasing means pushes the bag outwards from the interior of the bag and/or pulls the bag away from the centre of the bag.

According to a fourth aspect of the invention there is provided a dispenser for containing and dispensing substances such as fluids, viscous substances and/or adherent substances, the dispenser comprising:

- a flexible bag adapted to contain a substance to be discharged,
- a one-way output nozzle in sealed communication with the interior of the bag and adapted for discharging the contents of the bag,
- a substantially impermeable receptacle, the bag being arranged within the receptacle and the receptacle being sealed within fluid being trapped between the exterior of the bag and the receptacle, the nozzle being arranged on a surface of the receptacle, a one-way fluid intake valve arranged on the receptacle for intaking fluid into the receptacle and around the exterior of the bag, and a fluid-intake pump.

Ideally, the fluid-intake pump is operable by hand.

Ideally, the fluid-intake pump is operably connected to the fluid-intake valve such that, when operated, the fluid-intake pump pumps fluid through the valve into the receptacle.

Advantageously, as fluid is pumped into the receptacle the bag is compressed and the contents of the bag are forced out the nozzle.

In this embodiment, the receptacle can be formed from non-resilient materials such as glass or metal.

Advantageously, this uses less plastic and is therefore more environmentally friendly.

It will be appreciated that optional features applicable to one aspect of the invention can be used in any combination, and in any number. Moreover, they can also be used with any of the other aspects of the invention in any combination and in any number. This includes, but is not limited to, the dependent claims from any claim being used as dependent claims for any other claim in the claims of this application.

The invention will now be described with reference to the accompanying drawings which shows by way of example only five embodiments of an apparatus in accordance with the invention.

Figure 1:
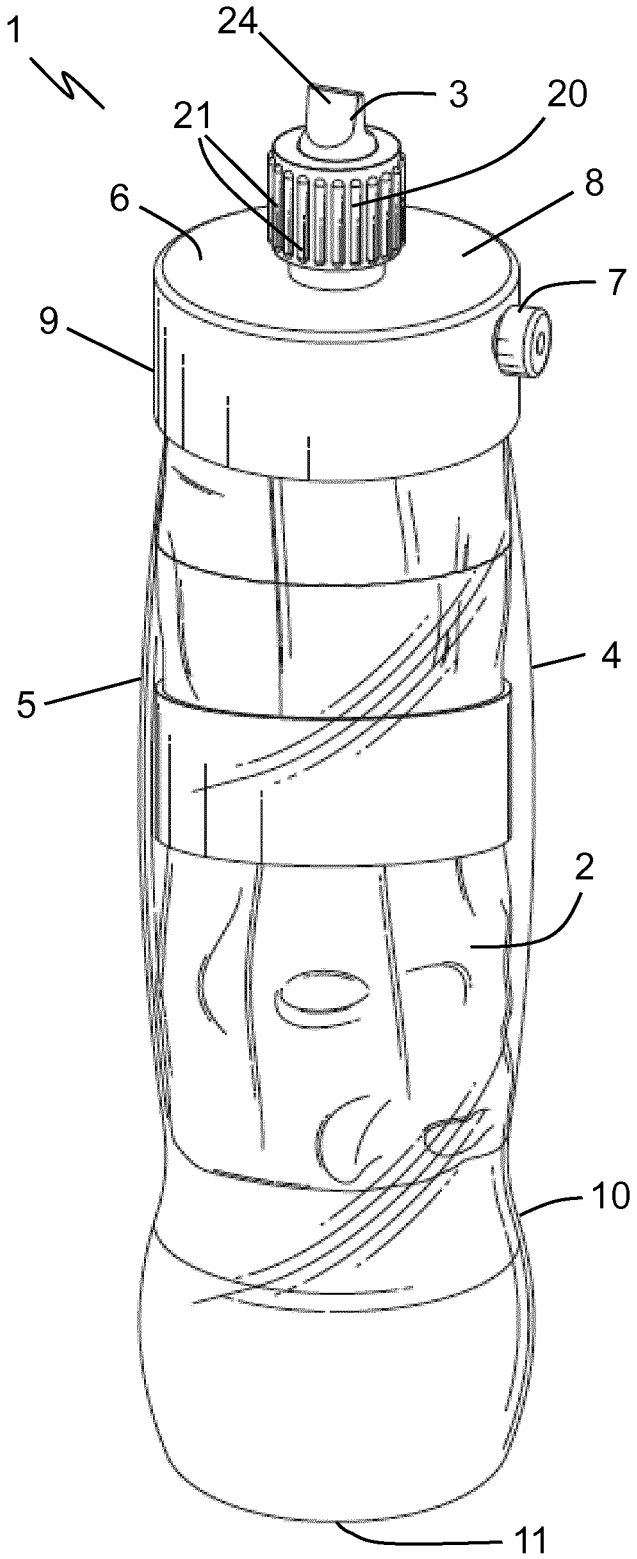
FIG. 1 is a perspective view of a first embodiment of a dispenser according to an aspect of the invention.

In FIG. 1 there is shown a dispenser according to a first embodiment of the invention indicated generally by reference numeral 1. The dispenser 1 has a flexible bag 2 which is adapted to contain a substance to be discharged from a nozzle 3. The nozzle 3 is an one-way output nozzle and is in fluid communication with the interior of the bag 2. The dispenser 1 further has a receptacle 4. The receptacle 4 is formed from flexible, resilient polymeric plastic and is thick enough to be impermeable to air under standard temperature and pressure but also thin enough such that a user can squeeze the receptacle 4 to reduce its volume. The receptacle 4 has a main body 5 and a cap 6 and the nozzle 3 is present on the cap 6. The main body 5 is cylindrical with curved portions to enhance grip, and also elongate, with the main body wall 10 extending from an opening (not shown) to a base 11.

The nozzle 3 is integrally formed with the cap 6 and air cannot enter the receptacle between the nozzle 3 and the cap 6 when the nozzle 3 is fitted to the cap 6. The cap 6 further forms an airtight seal with the main body 5. The cap 6 has a planar, circular surface 8 from which the nozzle 3 extends, the axis of the nozzle 3 being perpendicular to the plane of the circular surface 8. The cap 6 further has a skirt 9 which depends from the circular surface 8 over a portion of the main body 5 when the dispenser 1 is assembled. The skirt 9 is arranged perpendicular to the plane of the circular surface 8. The cap 6 further has a one-way air intake valve 7 arranged on the skirt 9. The air intake valve 7 permits air to enter the receptacle 4 through the cap 6 but does not permit air to leave the receptacle 4. It should be understood that the one-way output nozzle 3 need not be entirely one-way; some air intake through the nozzle 3 is permissible provided the rate of intake is less than that of the rate of intake of the one-way air intake valve 7 such that air fills the space around the bag as opposed to the interior of the bag when an amount of contents has been dispensed.

Figure 2:
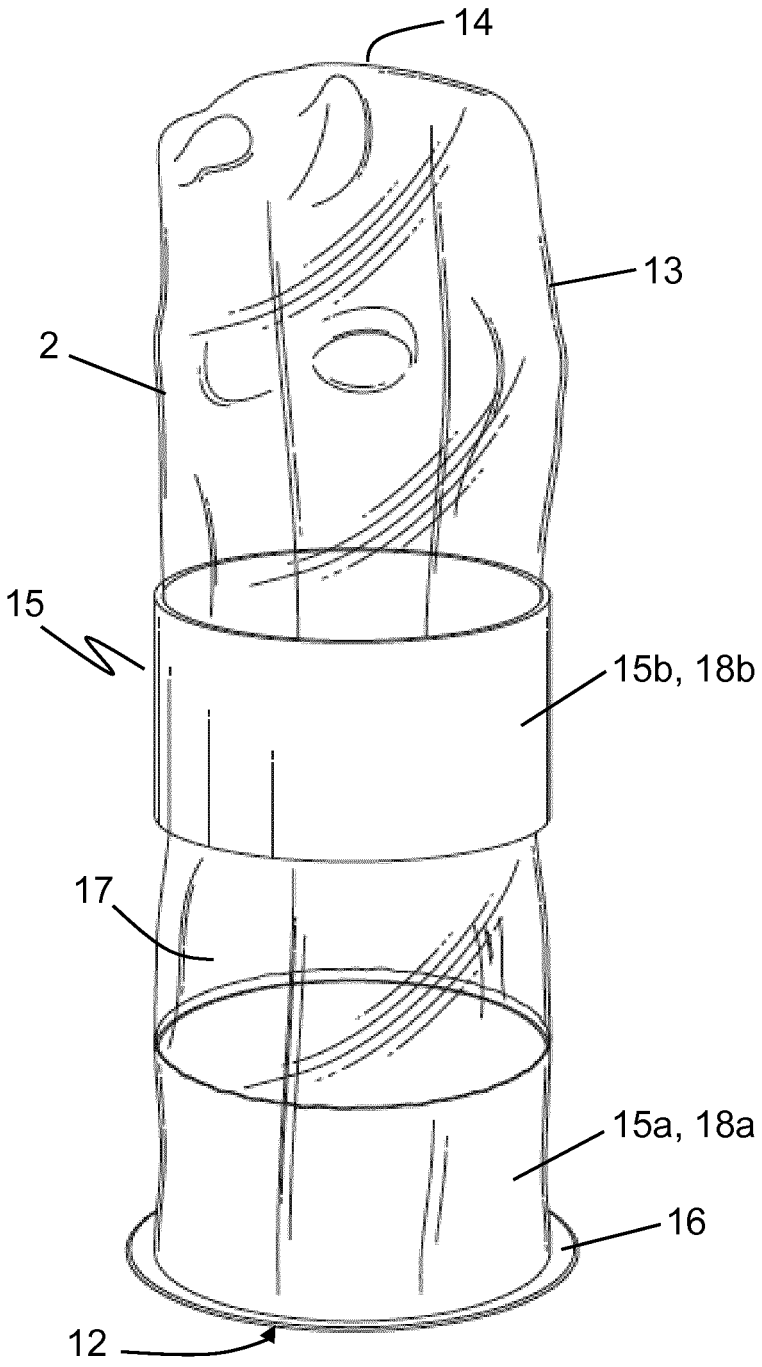
FIG. 2 is perspective view of a flexible bag according to the invention.
Figure 3:
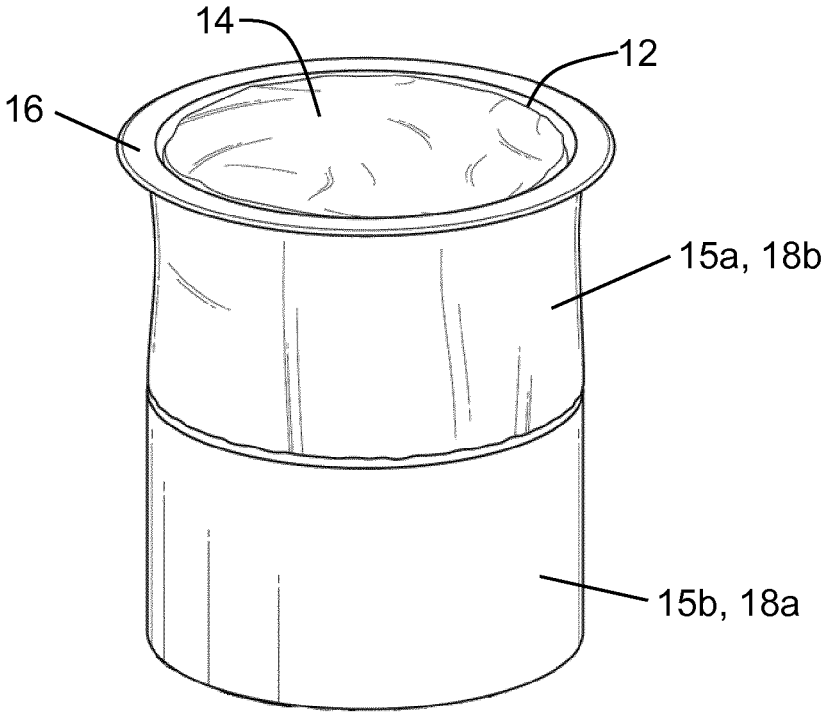
FIG. 3 is perspective view of the bag in FIG. 2 when the bag is collapsed.
Figure 4:
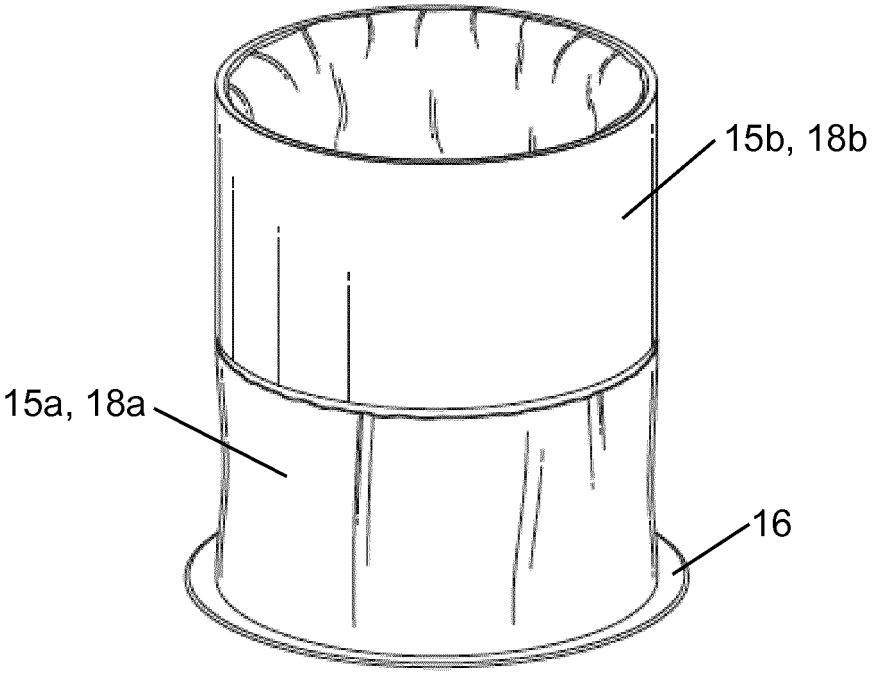
FIG. 4 is an inverted view of FIG. 3.
Figure 5:
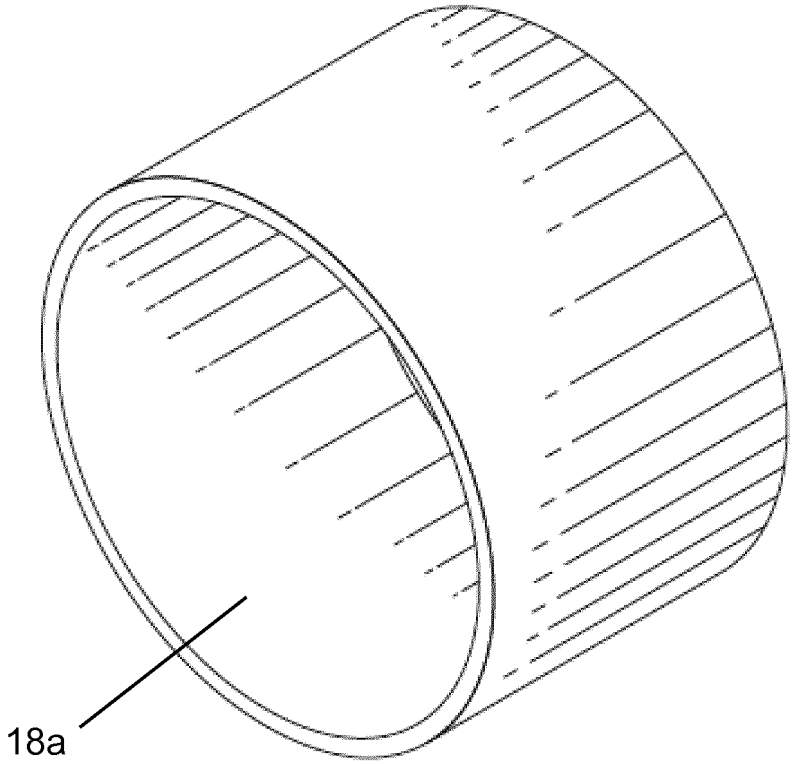
FIG. 5 is a perspective view of a structural support according to the invention.
Figure 6:
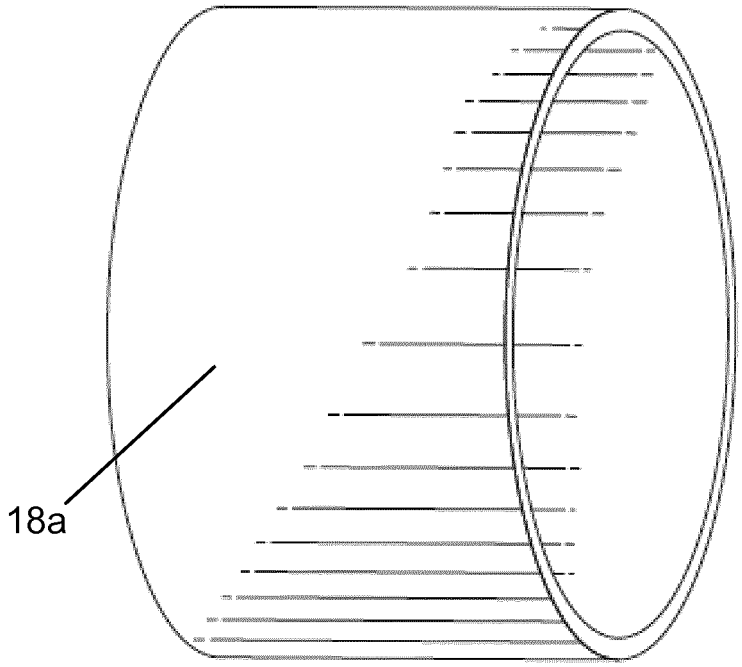
FIG. 6 is an alternative perspective view of FIG. 5.
Figure 7:
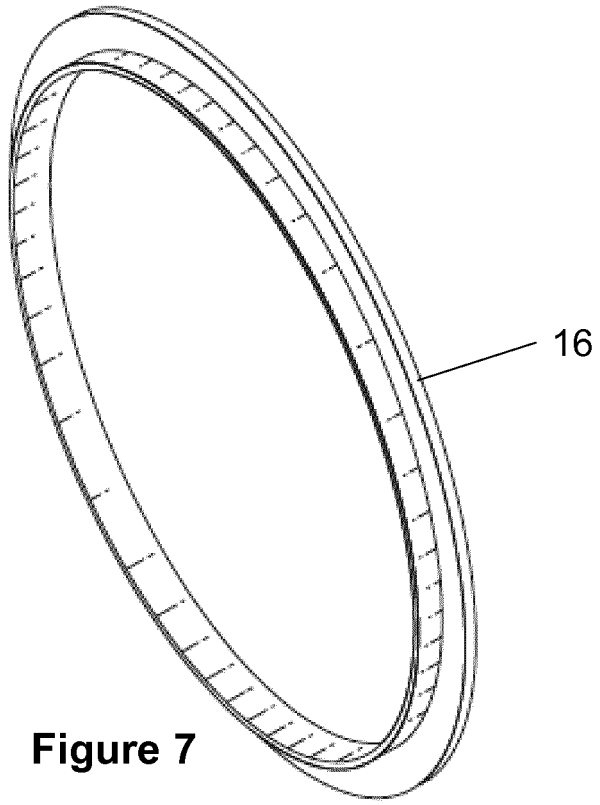
FIG. 7 is a perspective view of a lip according to the invention.
Figure 8:
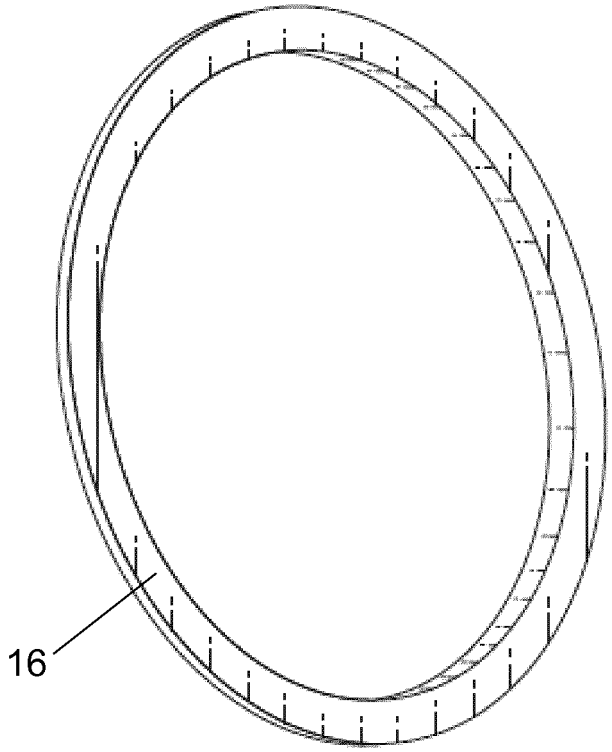
FIG. 8 is an alternative perspective view of FIG. 7.

The flexible bag 2, as illustrated clearly in FIGS. 2 to 4 with component parts further illustrated in FIGS. 5 to 8, is substantially cylindrical when extended. It has an opening 12 with a circular perimeter and the wall 13 of the bag 2 extends down from the opening 12 to the base 14 of the bag 2. The dispenser 1 has an arrangement 15 for preventing the bag 2 from blocking the nozzle 3. In this embodiment, the arrangement 15 is provided by the bag 2 having two rigidified portions: a first rigidified portion 15*a* and a second rigidified portion 15*b*. The first rigidified portion 15*a* is located at the opening 12 and the second rigidified portion 15*b* is located about halfway between the opening 12 and the bag base 14. The bag 2 further has an arrangement for engaging with the receptacle or cap, the arrangement involving a lip 16. The first rigidified portion 15*a* is further engaged with the lip 16, which is disposed at the opening 12 of the bag 2. The main body 5 has a rim (not shown), the lip 16 is formed to be seated on the rim of the main body 5. When the cap 6 is arranged on the main body 5, the planar surface 8 of the cap presses the lip 16 against the rim of the man body 5, fixing and sealing the bag 2 within the main body 5. A non-rigidified portion 17 extends between the two rigidified portions 15*a*, 15*b*. The rigidified portions 15*a*, 15*b* each extend around the entire perimeter of the bag 2, the perimeter being orthogonal to the longitudinal axis of the bag. The dispenser 1 has an arrangement for rigidifying a portion of the bag 2. In this embodiment, the rigidified portions 15*a*, 15*b*, are each rigidified by cylindrical, structural support supports 18*a*, 18*b* to which the bag is attached to by an adhesive substance, thereby reinforcing and rigidifying these portions of the bag 2. Alternatively, the rigidified portions could be provided by the bag being formed from materials of different thicknesses or having different flexural rigidity. Alternatively again, the arrangement 15 for preventing the bag 2 from blocking the nozzle 3 could be provided by a structure (e.g. see structure 380 in FIG. 20) fixed to the interior of the receptacle 4 and the bag 2 thereby holding the bag 2 open. Another alternative could involve a structure being inserted into the interior of the bag 2 that holds a part of the bag 2 proximal the nozzle 3 open in use.

The cap 6 is arranged on the main body 5 of the receptacle 4 via a screw mechanism (not shown) and the receptacle 4 is openable by unscrewing the cap 6 thereby providing access to the bag 2. The bag 2 can be removed, refilled and/or replaced as is required. The lip 16 of the bag 2 is sized to sit around the opening of the receptacle 4 (not shown) thereby retaining the bag 2 at the opening of the receptacle 4. The location of the bag 2 is secured by screwing the cap 6 down onto the main body 5 over the opening.

In the embodiment illustrated in FIGS. 9 to 18, the dispenser 101 has a receptacle 104 with a main body 105 having a main body wall 110 and a cap 106. The receptacle 104 is formed from a hard plastic. The cap 106 has a series of parallel, raised ridges 130 equispaced apart around the cap 106 to enhance grip. The main body 105 has a screw-thread 151 for receiving the cap 106. The main body 105 has four apertures 150*a*, 150*b*, 150*c*, 150*d* each of which are alignable with the air-intake valve 107. The apertures 150*a*, 150*b*, 150*c*, 150*d* are equi-spaced apart around the perimeter of the main body 105 proximal to the opening of the main body 105 and extending through the screw-thread 151. The dispenser 101 has a fluid travel pathway that permits transfer of fluid into and/or throughout the receptacle 104, the fluid travel pathway permitting transfer of fluid from outside the dispenser 101 through the fluid-intake valve 107, into the receptacle 104 and around the exterior of the bag. The fluid travel pathway involves a fluid transfer arrangement that permits transfer of fluids such as air from between the fluid-intake valve 107 and the main body 105 of the receptacle 104, wherein fluid can move from the fluid-intake valve 107 to at least one of the apertures 150*a*, 150*b*, 150*c*, 150*d* on the receptacle 104. The fluid travel pathway further involves an inner-receptacle fluid travel arrangement which, in this embodiment, is provided by four parallel, rectilinear grooves 152*a*, 152*b* (and two others not shown) arranged on the interior of the receptacle 104 extending orthogonally to the receptacle base 111 for accommodating the transfer of air from the apertures 150*a*, 150*b*, 150*c*, 150*d* to the base 111 of the receptacle 104.

Figure 9:
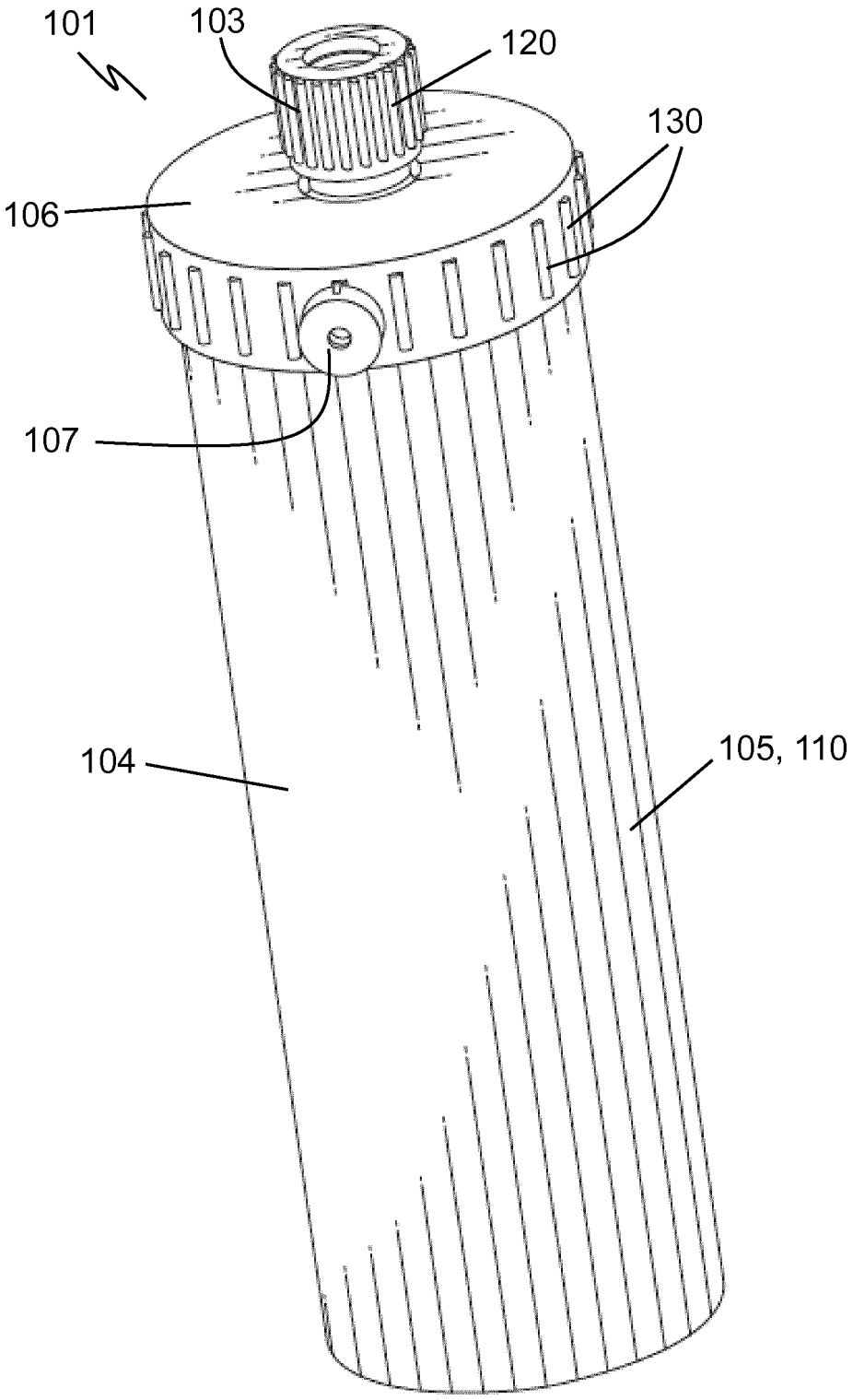
FIG. 9 is a perspective view of a second embodiment of a dispenser according to an aspect of the invention.
Figure 10:
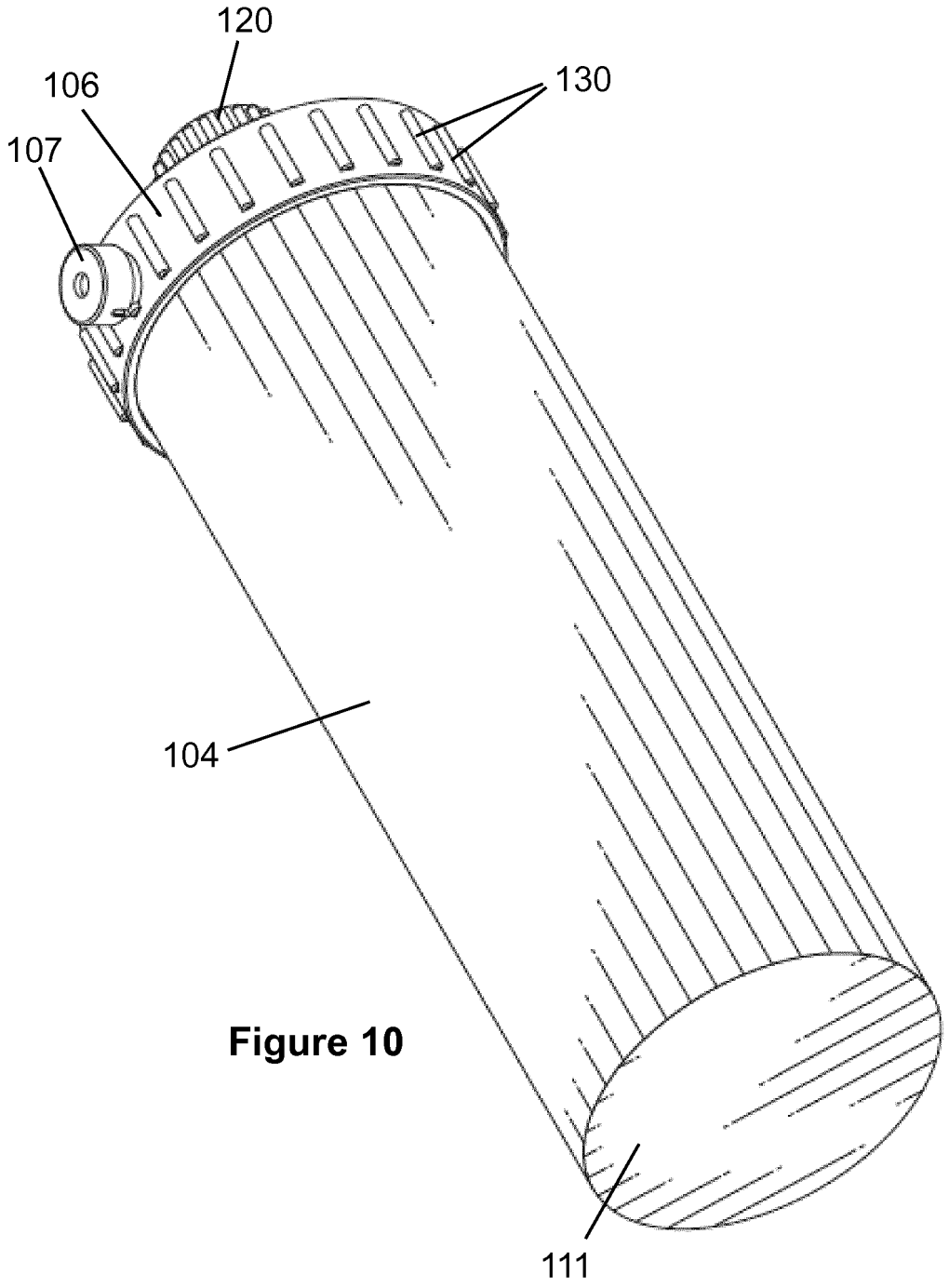
FIG. 10 is an alternative perspective view of the dispenser in FIG. 9.
Figure 11:
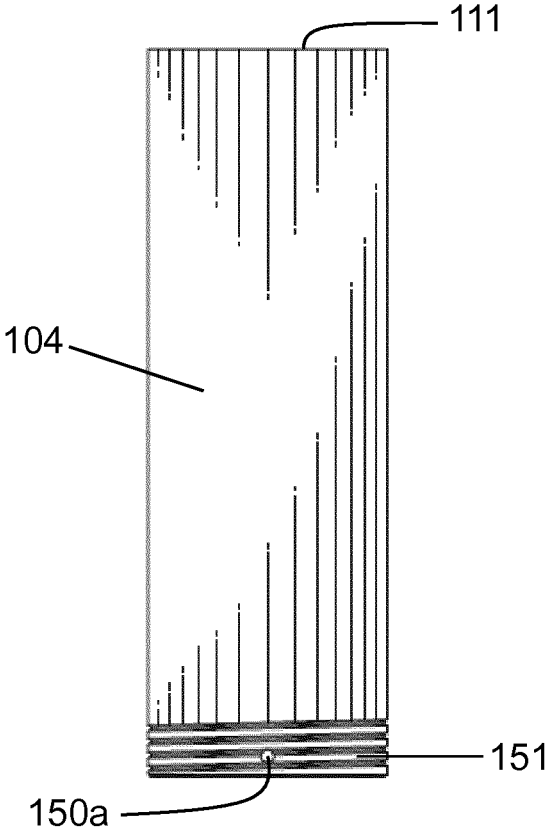
FIG. 11 is a front elevation view of a receptacle according to the invention.
Figure 12:
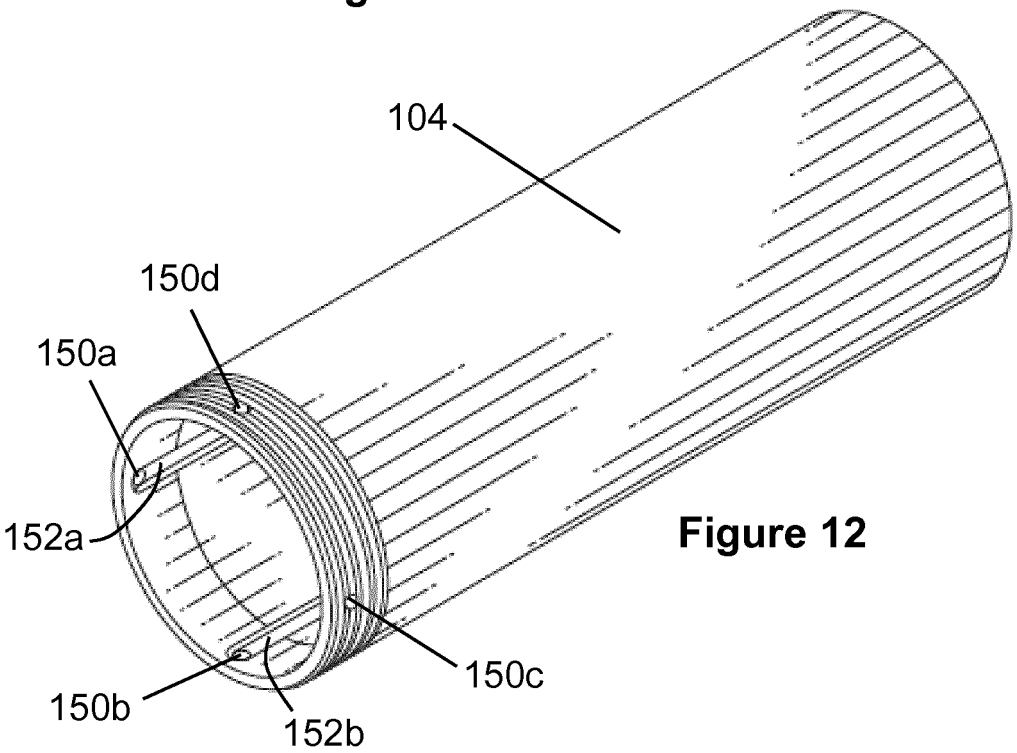
FIG. 12 is a perspective view of the receptacle in FIG. 11.
Figure 13:
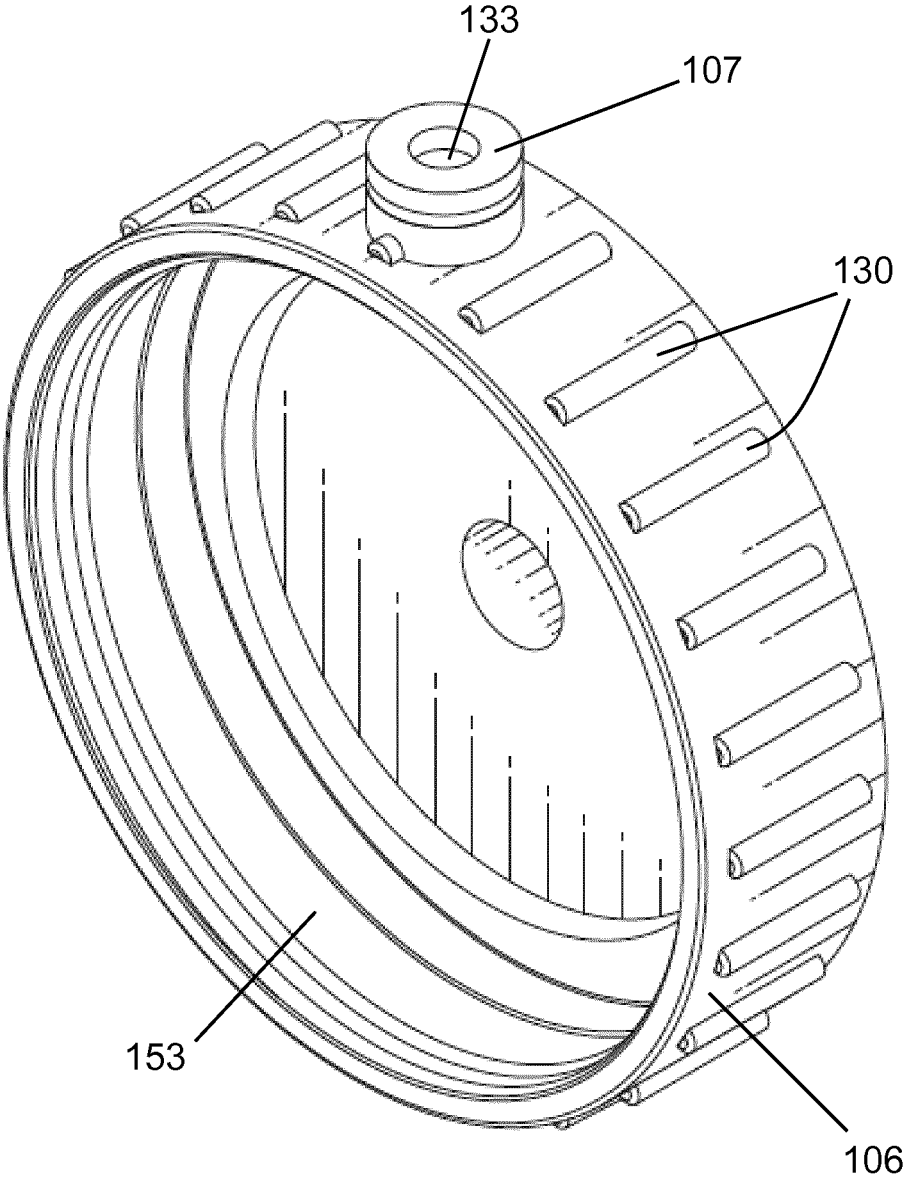
FIG. 13 is an underside perspective view of a cap according to the invention.
Figure 14:
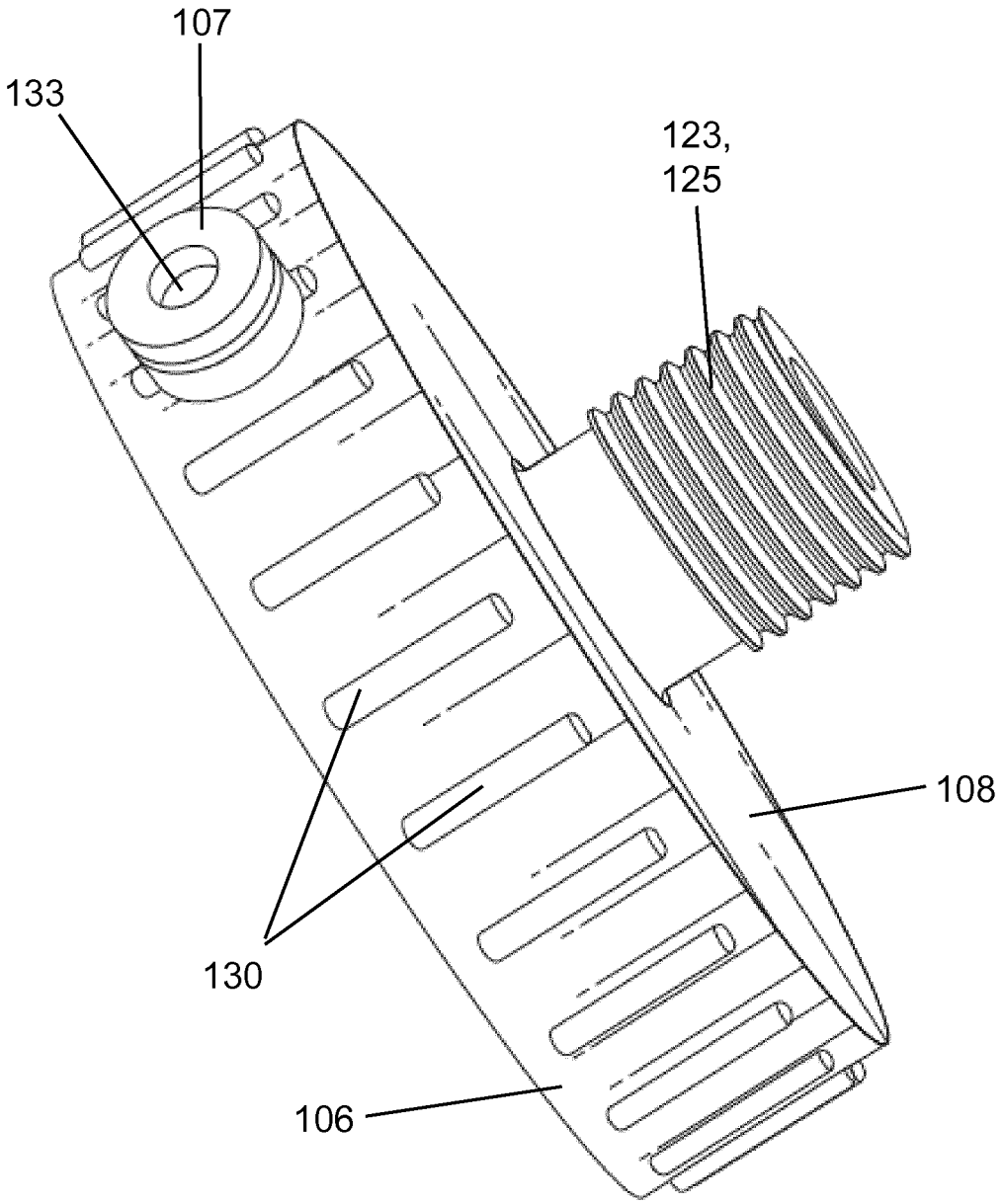
FIG. 14 is an alternative perspective view of the cap in FIG. 13.
Figure 15:
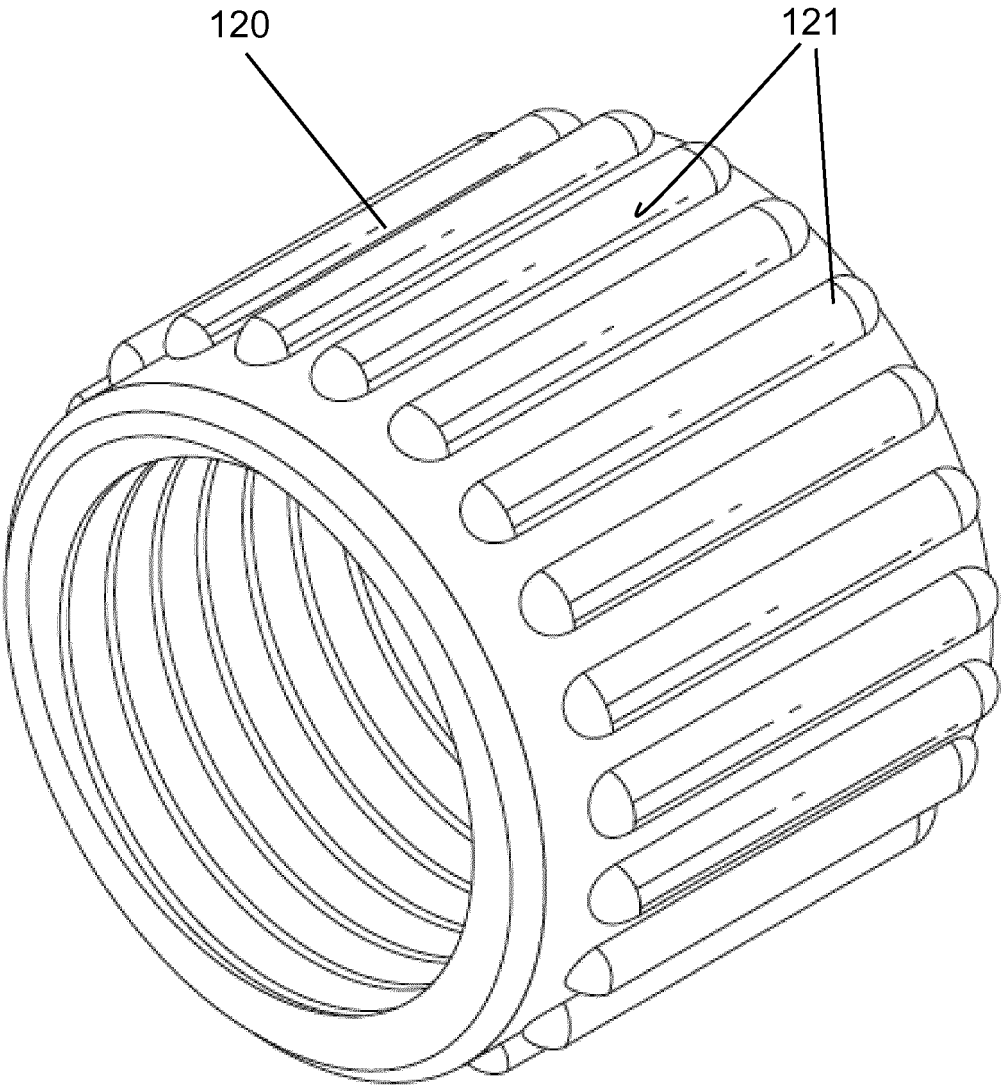
FIG. 15 is a perspective view of a part of a one-way output nozzle according to the invention.
Figure 16:
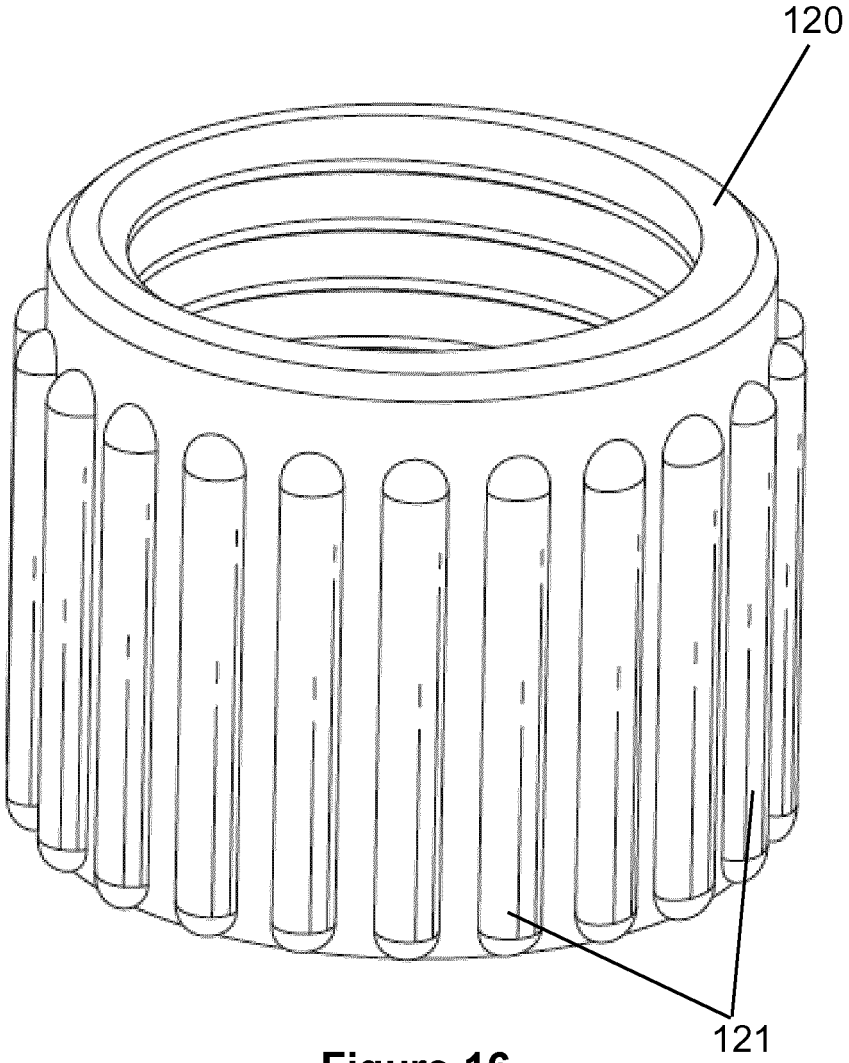
FIG. 16 is an alternative perspective view of the one-way output nozzle in FIG. 15.
Figure 17:
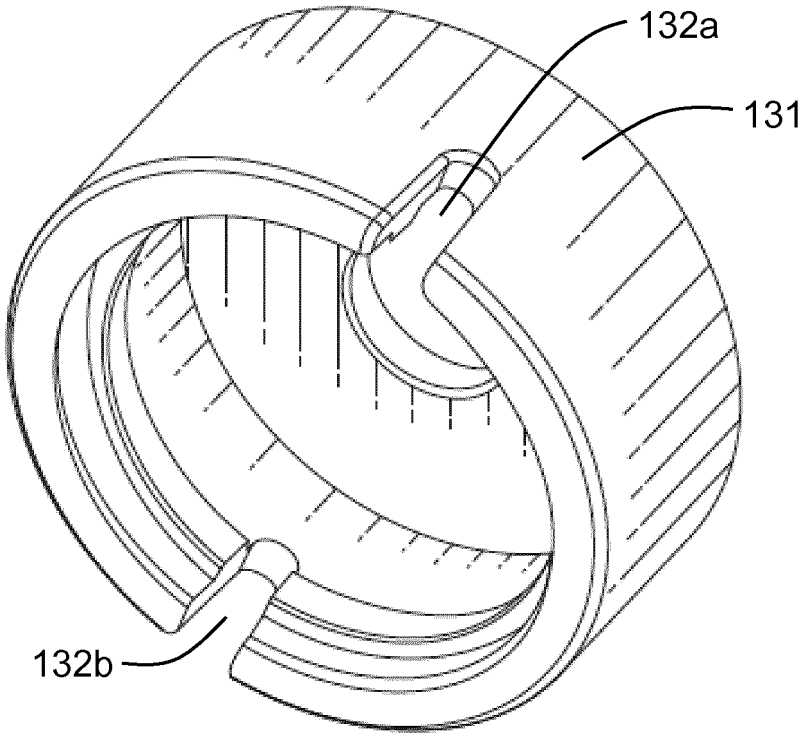
FIG. 17 is an underside perspective view of a part of a one-way air intake valve according to the invention.
Figure 18:
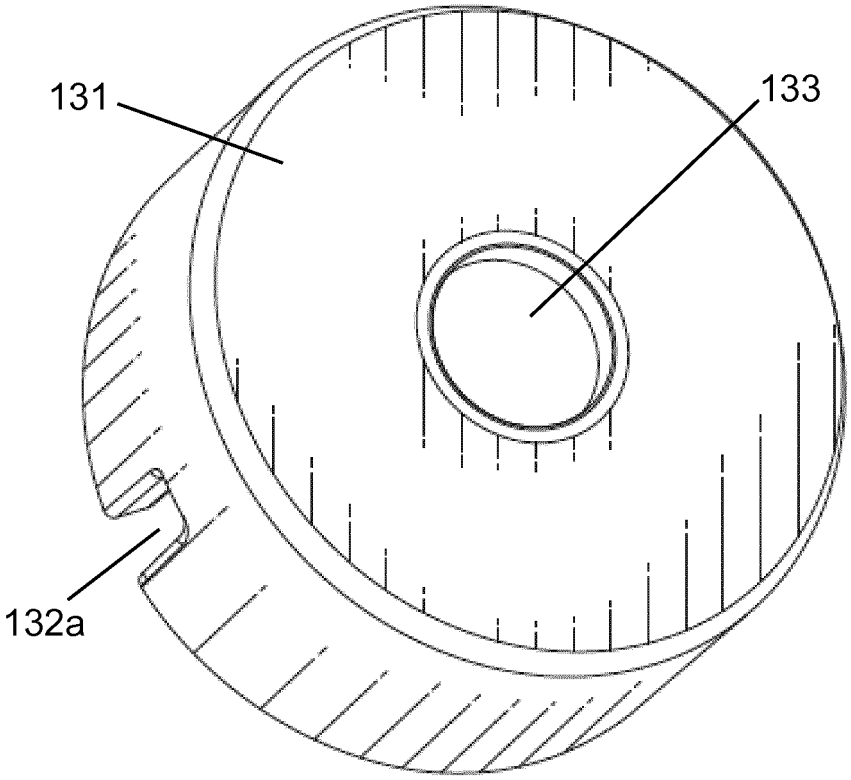
FIG. 18 is an alternative perspective view of the part of the air intake valve in FIG. 17.

When the dispenser 101 is assembled as shown in FIGS. 9 and 10, the air-intake valve 107 is in fluid alignment with at least one of the four apertures 150*a*, 150*b*, 150*c*, 150*d*. The fluid transfer arrangement involves a space formed between the cap 106 and the main body 105 of the receptacle 104. The cap 106 is partially threaded, with a non-threaded portion 153 creating a space between the cap 106 and the main body 105 for permitting air transfer from the air-intake valve 107 to the apertures 150*a*, 150*b*, 150*c*, 150*d* when the cap 106 is arranged on the main body 105. When the cap 106 is arranged on the main body 105, a fluid-tight boundary between the cap 106 and the main body 105 is formed by the cap 106 pressing against the bag and the rim of the main body 105 of the receptacle 104.

In both of the embodiments illustrated the nozzle 3, 103 is formed from a tube 125 (not shown in the drawings of the first embodiment) centrally located on the cap's planar surface 108 and extending orthogonally therefrom. The nozzle 3, 103 further has a cylindrical nozzle adjuster 20, 120 arranged over the tube 125 (see FIGS. 1, 9, 10, 15 and 16). The nozzle adjuster 20, 120 has a series of raised ridges 21, 121 for grip and an internal screw thread 22, 122 for engaging with a corresponding screw thread 123 on the cap 7, 107. Rotating the nozzle adjuster 20, 120 relative to the tube 125 moves the nozzle adjuster 20, 120 axially relative to the internal screw thread 22, 122. The nozzle 3 further has a plastic duckbill 24 arranged in the centre of the tube 125. The nozzle adjuster 20 retains the duckbill 24 in the tube 125 (not shown in first embodiment) and can be operated to adjust the flowrate of the contents through the duckbill 24.

In the embodiment shown in FIGS. 9 to 18, the one-way air intake valve 107 has a cover 131 with an aperture 133 for fluid transfer into the valve 107 and two openings 132*a*, 132*b* shaped to accommodate one of the ridges 130 of the cap 106 thereby allowing the valve cover 131 to sit flush against the cap 106. The valve 107 is an inward-facing duckbilled valve (not shown).

In use, the embodiment shown in FIGS. 1 to 8 is operated by squeezing the receptacle 4. This reduces the volume of the receptacle 4 and the bag 2 and forces the contents of the bag out the nozzle 3. When the receptacle 4 is released it returns to its original shape and air is drawn in through the air-intake valve 7. As no air can enter the bag 2, it remains in a deformed shape with a reduced volume. The contents of the bag 2 are therefore always located adjacent to the nozzle 3. The receptacle 4 can be repeatedly squeezed and released to force the contents of the bag out of the nozzle 3. As the contents are disposed and the bag 2 reduces in volume through use, the non-rigidified portion 17 of the bag 2 and the portion of the bag between the second rigidified portion 15*b* and the base 14 of the bag collapses inwards, and the second rigidified portion 15*b* moves towards the first rigidified portion 15*a*.

When the bag 2 is emptied, as shown in FIGS. 3 and 4, the two rigidified portions 15*a*, 15*b* are adjacent to each other and the non-rigidified portion 17 and the base 14 of the bag 2 are located within the centre of the rigidified portions 15*a*, 15*b*. The combined length of the two rigidified portions 15*a*, 15*b* is equal to that of the length of the portion of the bag 2 that extends from the second rigidified portion 15*b* to the base 14 of the bag 2. The rigidified portions 15*a*, 15*b* prevent the non-rigidified portions of the bag 2 from gathering around the nozzle 3 thereby leaving the nozzle 3 unobstructed and open for the passage of the contents of the bag 2. The bag 2 can be refilled or replaced by removing the cap 6 and refilling or lifting the bag 2 out of the main body 5 for replacement.

The embodiment shown in FIGS. 9 to 18 is operated by a user sucking the contents of the bag out of the dispenser 101 through the nozzle 103. As the volume of the bag decreases, air enters the receptacle 104 via the air intake valve 107 to replace the diminished volume. When the bag is being removed or replaced, the grooves 152*a*, 152*b*, 152*c*, 152*d* provide a space within the receptacle 104 permitting movement of air between the base 111 of the receptacle and the apertures 150*a*, 150*b*, 150*c*, 150*d*, even when the bag is pressing against the sidewall of the receptacle 104. The user therefore experiences little or no resistance when inserting the bag into, or removing the bag from, the receptacle 104.

Figure 19:
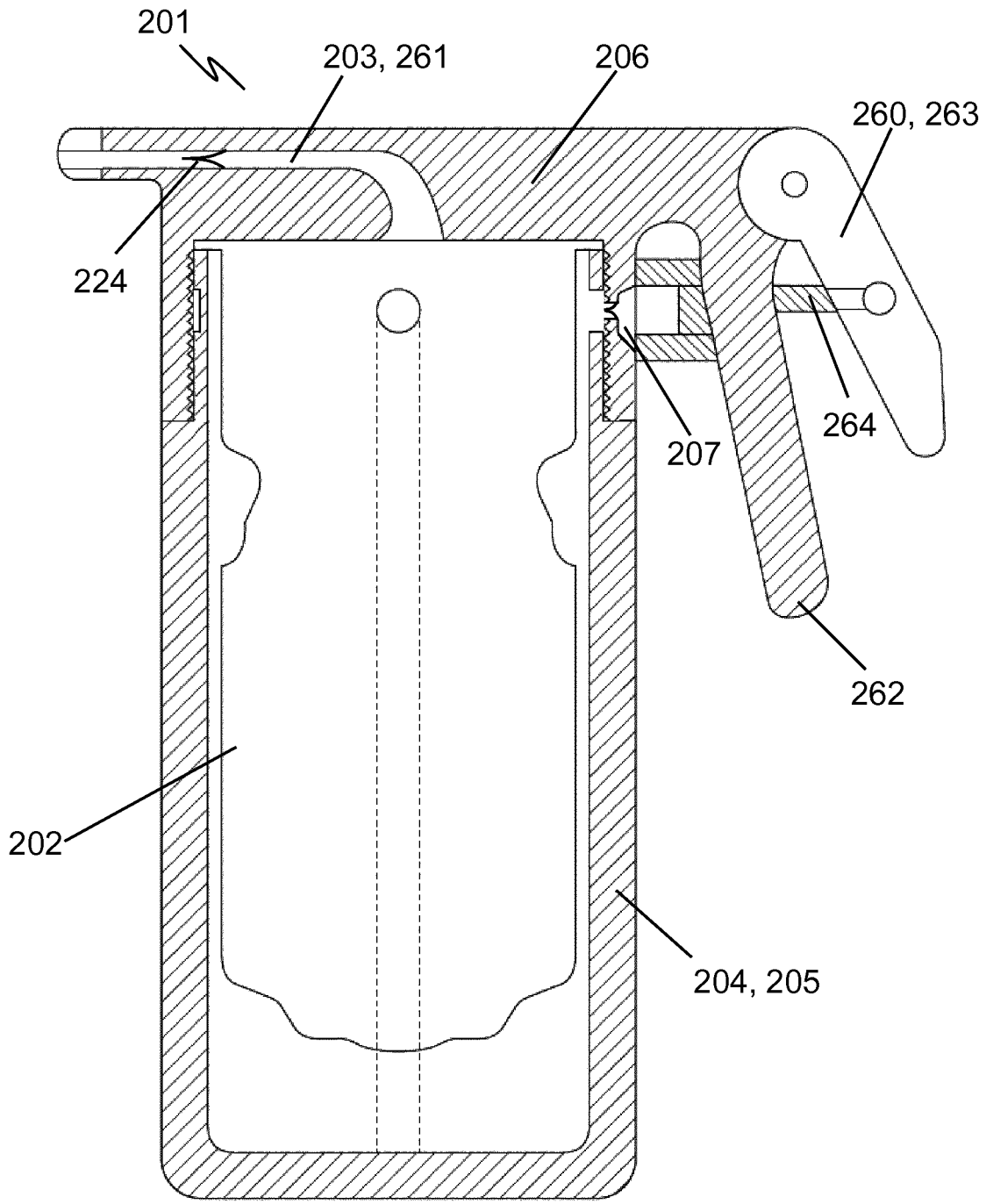
FIG. 19 is a cross-section of a further embodiment of the invention.

In the embodiment in FIG. 19 there is shown a dispenser 201, The dispenser 201 has a cap 206 that is screwed onto a main body 205 of the receptacle 204. The cap 206 has a hand-operated pump 260 which, when operated, forces air into the receptacle 204 through a one-way input valve 207. The pump 260 has a fixed handle 262 and a moveable handle 263 that is pivotally arranged with the fixed handle 262 and can pivot towards/away from the fixed handle 262. The moveable handle 263 is operably linked with a piston 264 arranged to move towards/away from the fluid-intake valve 207. When the moveable handle 263 is squeezed towards the fixed handle 262, the piston 264 moves towards and forces air through the fluid-intake valve 207. The cap 206 is arranged with a one-way output nozzle 203 which has an internal duckbill valve 224 located in nozzle tube 261 that extends from the bag 202 to the outlet of the nozzle 203. The duckbill valve 224 prevents fluid from entering the bag 202 via the nozzle 203.

Figure 20:
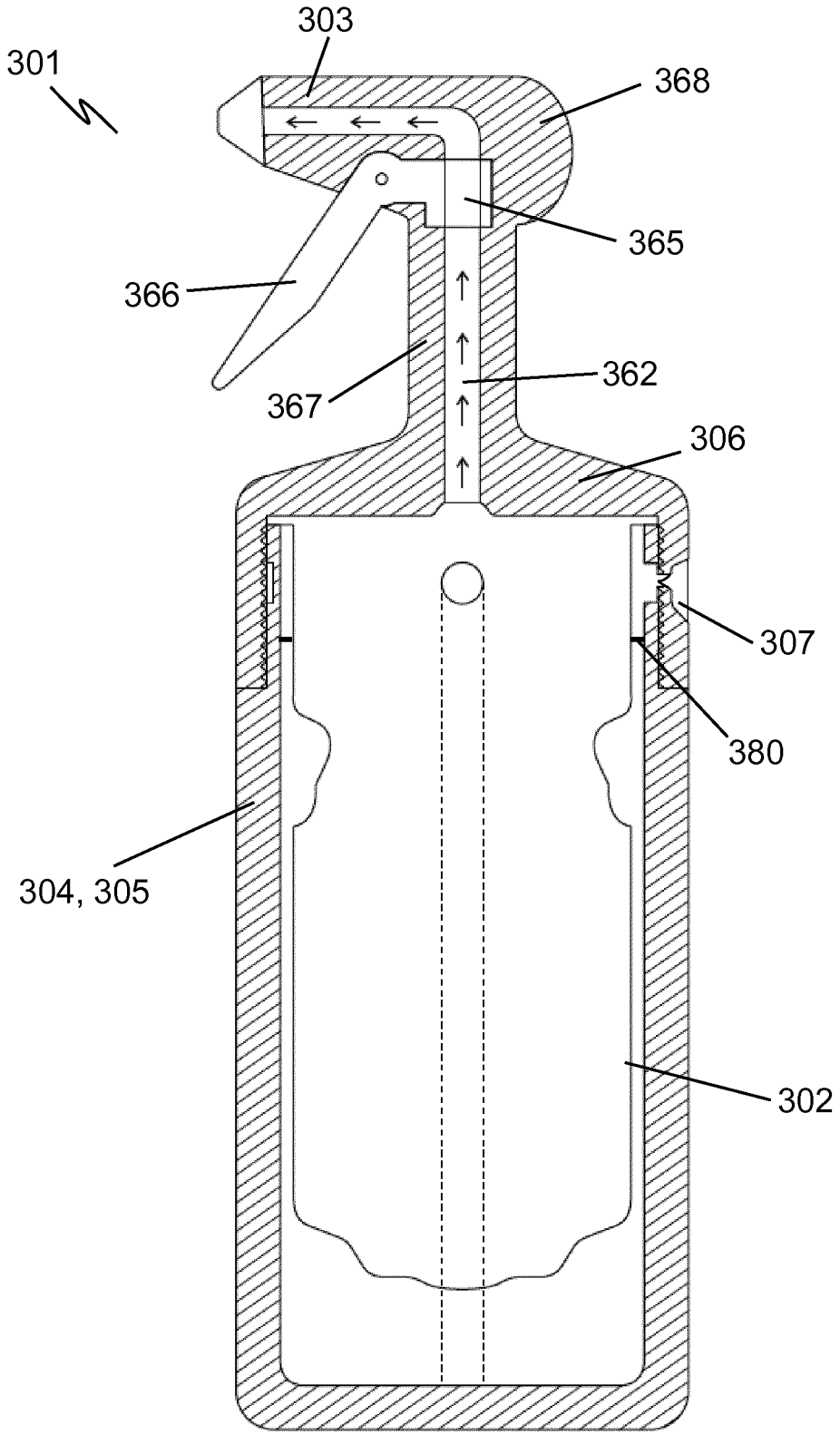
FIG. 20 is a cross-section of yet a further embodiment of the invention.

In the embodiment in FIG. 20 there is shown a dispenser according to the invention, indicated generally by reference numeral 301. This dispenser 301 has an extraction pump 365 for drawing the contents of the bag 302 through a nozzle tube 362 at out the outlet of the nozzle 303. The cap 306 is formed with a neck 367 that extends away from the main body 305 of the receptacle 304, and a head 368 that contains the outlet of the nozzle 303. The nozzle tube 362 extends up through the neck 367 to the head 368. The extraction pump 365 has a moveable handle 366 that is pivotally connected to the head 367. The user can grip the neck 367 and squeeze the handle 366 towards the neck 367 to draw the contents of the bag 302 out and towards the outlet of the nozzle 303. In doing so, air enters the fluid-intake valve 307 to fill the space around the exterior of the bag 302. As the embodiments in FIGS. 19 and 20 are fitted with pumps, and are not reliant on squeezing the dispenser or sucking the contents through the nozzle, it is possible that the receptacle in these embodiments is formed from glass or rigid metal. It should also be noted that a single receptacle could be formed that could be used interchangeably with the cap of the embodiment in FIGS. 9 to 18, or the cap of FIG. 19 or the cap of FIG. 20.

Figure 21:
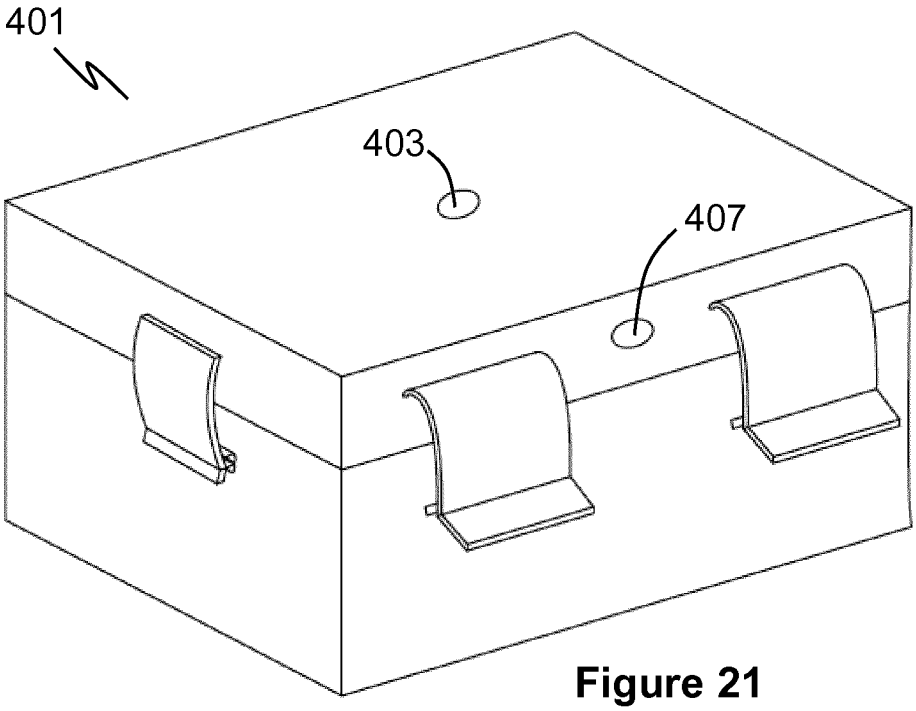
FIG. 21 is a perspective view of yet a further embodiment of the invention.
Figure 22:
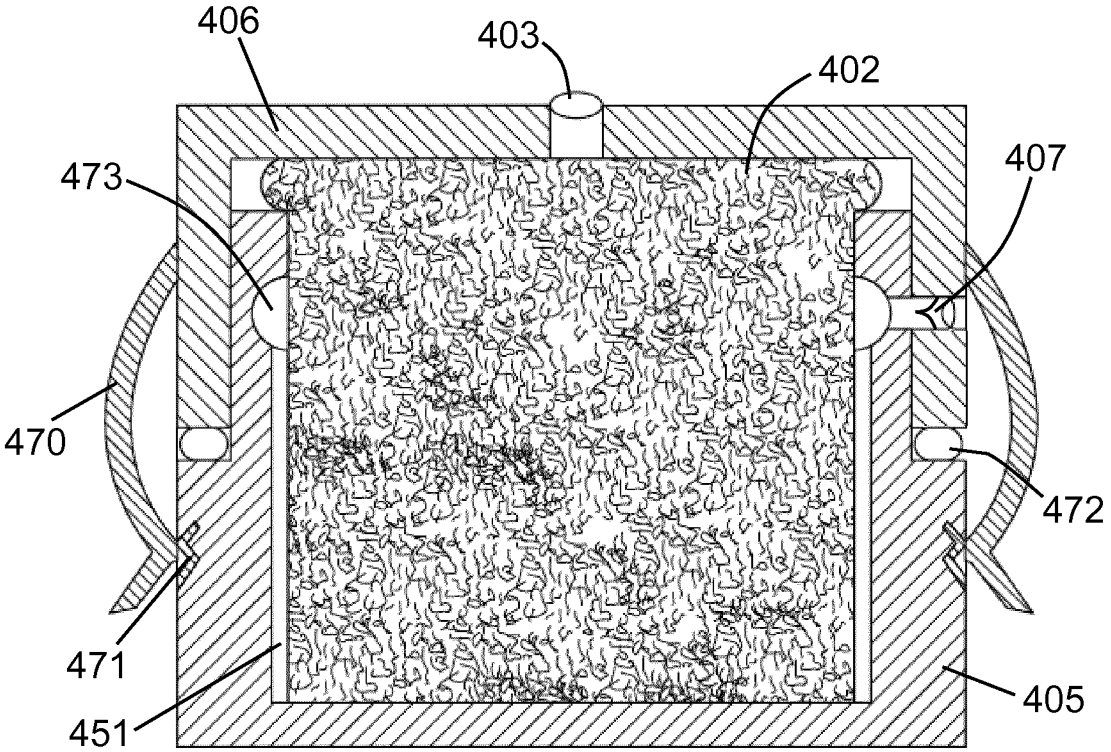
FIG. 22 is a cross-section view of the embodiment of FIG. 21.

In the embodiment in FIGS. 21 and 22 there is shown a dispenser according to the invention, indicated generally by reference numeral 401. The dispenser 401 is cuboid in shape, showing the possible diversity in shape of dispensers according to the invention. The dispenser 401 has a fluid-intake valve 407 and a one-way output nozzle 403. The main body 405 has an interior perimeter groove 473 to permit movement of fluid from the fluid-intake valve 407 around the perimeter of the interior of the main body 405. Additionally, there are longitudinal grooves 452 that are in fluid communication with the perimeter groove 473 to allow transfer of fluid down towards the base of the main body 405. Instead of a screw-type connection between the cap 406 and the main body 405, the cap 406 is releasably fastened to the main body 405 by a series of fasteners 470. Each fastener 470 is hingedly connected to, and extends down from, the cap 406 and engages with a receiving arrangement 471 on the surface of the main body 405. The main body 405 further has a compressible seal 472 arranged between the cap 406 and the main body 405 when the cap 406 is fitted. The compressible seal 472 rests on a shoulder of the main body 405 and is compressed towards the shoulder when the cap 406 is fastened on the main body 405. The seal 472 ensures that the connection between the cap 406 and the main body 405 is airtight. The dispenser 401 can then be used with an extraction pump or a fluid-intake pump as described previously to force the contents of the bag 402 out of the nozzle 403.

In an embodiment (not shown) the dispenser has a stand that is integrally formed with the receptacle, or a stand that is provided separately. The stand is arranged extending from the receptacle, most preferably from the cap, to a distance beyond the nozzle such that the dispenser can be set on a surface with the nozzle being located between the surface and the location of the bag. The dispenser can be stored in this position. As the bag is emptied, the centre of gravity of the dispenser moves towards the nozzle. By storing the dispenser with the nozzle close to a surface, the centre of gravity is also correspondingly closer to the surface than if the dispenser were stored with the nozzle orientated away from the surface. This makes it less easy to topple the dispenser.

In the preceding discussion of the invention, unless stated to the contrary, the disclosure of alternative values for the upper or lower limit of the permitted range of a parameter, coupled with an indication that one of the values is more highly preferred than the other, is to be construed as an implied statement that each intermediate value of the parameter, lying between the more preferred and the less preferred of the alternatives, is itself preferred to the less preferred value and also to each value lying between the less preferred value and the intermediate value.

The features disclosed in the foregoing description or the following drawings, expressed in their specific forms or in terms of a means for performing a disclosed function, or a method or a process of attaining the disclosed result, as appropriate, may separately, or in any combination of such features be utilised for realising the invention in diverse forms thereof.

The invention claimed is:

1. A dispenser for containing and dispensing substances such as fluids, viscous substances and/or adherent substances, the dispenser comprising: a bag adapted to contain a substance to be discharged, wherein the bag is a flexible bag, a nozzle that is in sealed communication with the interior of the bag and is adapted for discharging the contents of the bag, wherein the nozzle is a one-way output nozzle; a receptacle that is substantially impermeable, the bag being arranged within the receptacle and the receptacle being sealed with fluid being trapped between the exterior of the bag and the receptacle, the nozzle being arranged on a surface of the receptacle; a fluid intake valve arranged on the receptacle for intaking fluid into the receptacle and around the exterior of the bag, wherein the fluid-intake valve is a one-way fluid-intake valve and; a means for preventing the bag from blocking the nozzle, wherein the receptacle comprises a cap and a main body and wherein the cap is at least partially removable from the main body of the receptacle, and wherein the nozzle and the fluid-intake valve is disposed on the cap, wherein the main body of the receptacle comprises at least one aperture alignable with the fluid-intake valve such that fluid communication between the aperture and the fluid-intake valve is permissible, and wherein the dispenser comprises a fluid travel pathway to permit transfer of fluid into and/or throughout the receptacle, wherein the fluid travel pathway permits transfer of fluid from outside the dispenser through the fluid-intake valve, into the receptacle and around the exterior of the bag, wherein the fluid travel pathway comprises a fluid transfer means between the fluid-intake valve and the main body of the receptacle, and wherein the fluid transfer means permits transfer of fluid from the fluid-intake valve to at least one aperture on the receptacle when the cap is arranged on the main body, and wherein the fluid travel pathway comprises an inner-receptacle fluid travel means located on the inside of the receptacle, the inner receptacle fluid travel means being operable to permit free movement of fluid around the interior of the main body of the receptacle even when the main body contains contents such as the bag, the inner-receptacle fluid travel means comprising at least one groove, channel and/or tube, and wherein the inner-receptacle fluid travel means extends from the aperture of the receptacle along the main body of the receptacle.

2. A dispenser as claimed in claim 1 wherein the means for preventing the bag from blocking the nozzle comprises a portion of the bag being rigid and/or rigidified.

3. A dispenser as claimed in claim 2 wherein the rigid/rigidified portion of the bag is proximal the nozzle.

4. A dispenser as claimed in claim 3 wherein the flexible bag comprises a plurality of rigid/rigidified portions, the plurality of rigid/rigidified portions being spaced apart from one another and being separated by a less-rigid/non-rigidified portion extending therebetween.

5. A dispenser as claimed in claim 2 wherein the means for preventing the bag from blocking the nozzle comprises a means for rigidifying a portion of the bag, the means for rigidifying a portion of the bag forming the rigid/rigidified portion of the bag.

6. A dispenser as claimed in claim 1 wherein the bag is adapted to form a seal with the cap and/or the main body such that the interior of the bag is in communication with the nozzle and the exterior of the bag is in fluid communication with the fluid-intake valve.

7. A dispenser as claimed in claim 6 wherein part of the bag is disposed between the cap and the main body.

8. A dispenser as claimed in claim 1 wherein the bag comprises a means for engaging with the receptacle or cap, wherein the means for engaging with the receptacle or cap comprises a lip shaped to engage with receptacle to retain the bag at the receptacle.

9. A dispenser as claimed in claim 1 wherein the receptacle is formed from flexible, resilient material and is thereby compressible such that the receptacle can be squeezed by a user thereby temporarily reducing the volume of the receptacle.

10. A dispenser as claimed in claim 1 wherein the dispenser comprises a fluid-intake pump that is operably connected to the fluid-intake valve such that, when operated, the fluid-intake pump pumps fluid through the valve into the receptacle.

11. A dispenser as claimed in claim 10 wherein the receptacle is formed from rigid and/or non-resilient materials such as glass or some metals.

12. A dispenser as claimed in claim 1 wherein the fluid transfer means comprises a space formed between the cap and the main body of the receptacle when the cap is arranged on the main body.

13. A dispenser as claimed in claim 12 wherein the fluid-intake valve is in sealed fluid-communication with the space when the cap is arranged on the main body of the receptacle.

14. A dispenser as claimed in claim 13 wherein the space is formed from a groove and/or a non-threaded portion of the cap.

15. A dispenser as claimed in claim 13 wherein there are fluid-tight boundaries above and below the space when the cap is arranged on the receptacle and wherein a fluid-tight boundary of the space is defined by the cap pressing against the bag and/or the rim of the main body of the receptacle.

16. A dispenser as claimed in claim 1 wherein the inner-receptacle fluid travel means extends along the receptacle towards the base of the receptacle.

17. A dispenser as claimed in claim 1 wherein the one-way output nozzle is operably engaged with an extraction pump and wherein operation of the pump draws the contents of the bag out of the nozzle.

18. A dispenser as claimed in claim 1 wherein the cap is screw-fitted on to the main body of the receptacle.

19. A dispenser as claimed in claim 1 wherein the cap is fastened to the receptacle with fasteners that extend from the cap to a fastener receiving means on the receptacle, wherein the fasteners are clips that are hingedly arranged on the cap and wherein the fastener receiving means is a groove or channel for receiving a portion of the fastener and retaining the fastener thereto.

* * * * *